US012000278B2

(12) United States Patent
Chen et al.

(10) Patent No.: US 12,000,278 B2
(45) Date of Patent: Jun. 4, 2024

(54) DETERMINING OIL AND WATER PRODUCTION RATES IN MULTIPLE PRODUCTION ZONES FROM A SINGLE PRODUCTION WELL

(71) Applicant: Saudi Arabian Oil Company, Dhahran (SA)

(72) Inventors: Hsieh Chen, Cambridge, MA (US); Martin E. Poitzsch, Northumberland, NH (US); Hooisweng Ow, Woburn, MA (US); Ivan Cetkovic, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 67 days.

(21) Appl. No.: 17/644,641

(22) Filed: Dec. 16, 2021

(65) Prior Publication Data

US 2023/0193755 A1 Jun. 22, 2023

(51) Int. Cl.

| | |
|---|---|
| ***E21B 49/08*** | (2006.01) |
| ***E21B 34/06*** | (2006.01) |
| ***E21B 43/12*** | (2006.01) |
| ***E21B 47/11*** | (2012.01) |

(52) U.S. Cl.

CPC ..... *E21B 49/0875* (2020.05); *E21B 34/06* (2013.01); *E21B 43/12* (2013.01); *E21B 47/11* (2020.05)

(58) Field of Classification Search

CPC ..... E21B 43/16; E21B 43/24; E21B 47/11; G01F 1/7042

See application file for complete search history.

(56) References Cited

U.S. PATENT DOCUMENTS

| | | | |
|---|---|---|---|
| 3,623,842 | A | 11/1971 | Deans |
| 3,703,355 | A | 11/1972 | Takahashi |
| 3,834,122 | A | 9/1974 | Allison et al. |

(Continued)

FOREIGN PATENT DOCUMENTS

| | | |
|---|---|---|
| AU | 2011284552 | 12/2013 |
| CA | 2997608 | 4/2017 |

(Continued)

OTHER PUBLICATIONS

"Evolute Express User Guide," Biotage, 2016, Brochure, p. 3, p. 20-21, 36 pages.

(Continued)

*Primary Examiner* — Zakiya W Bates

(74) *Attorney, Agent, or Firm* — Fish & Richardson P.C.

(57) ABSTRACT

A wellbore that supplies production fluid from a first production zone and a second production zone is produced. Production fluids from the first and second production zone are comingled within a same production tubular. A first tracer is pulsed into the first production zone. A second tracer is pulsed into the second production zone. The first tracer and the second tracer are barcoded such that the first tracer and the second tracer can be differentiated from one another. A first tracer decay is measured at a topside facility. A second tracer decay is measured at the topside facility. A water cut of the first production zone and the second production zone is determined based upon the first tracer decay and the second tracer decay.

19 Claims, 7 Drawing Sheets

(56) References Cited

U.S. PATENT DOCUMENTS 3,851,171 A 11/1974 Saniford
3,947,396 A 3/1976 Kangas et al.
4,137,452 A 1/1979 Paap
4,264,329 A 4/1981 Beckett
4,289,203 A 9/1981 Swanson
4,420,565 A 12/1983 Schmitt
4,433,291 A 2/1984 Yariv et al.
4,485,071 A 11/1984 Larter
4,589,285 A 5/1986 Savit
4,650,281 A 3/1987 Jaeger et al.
4,694,046 A 9/1987 Bock et al.
4,755,469 A 7/1988 Showalter et al.
4,772,563 A 9/1988 Evangelista et al.
4,882,128 A 11/1989 Hukvari et al.
4,882,763 A 11/1989 Buchan et al.
4,976,270 A 12/1990 Parl et al.
5,096,277 A 3/1992 Kleinerman
5,124,268 A 6/1992 Dakubu
5,168,927 A 12/1992 Stegenneier
5,180,556 A 1/1993 Nolte et al.
5,390,529 A 2/1995 Ghiselli
5,441,343 A 8/1995 Pylkki et al.
5,990,224 A 11/1999 Raynolds et al.
6,095,679 A 8/2000 Hammiche et al.
6,226,390 B1 5/2001 Deruyter et al.
6,250,848 B1 6/2001 Moridis et al.
6,252,016 B1 6/2001 Wu et al.
6,331,436 B1 12/2001 Richardson
6,380,534 B1 4/2002 Mahmoud et al.
6,488,872 B1 12/2002 Beebe et al.
6,491,425 B1 12/2002 Hammiche et al.
6,555,807 B2 4/2003 Clayton et al.
6,585,044 B2 7/2003 Rester
6,590,647 B2 7/2003 Stephenson
6,638,885 B1 10/2003 McGrath et al.
6,662,627 B2 12/2003 Arnott et al.
6,691,780 B2 2/2004 Nguyen et al.
6,939,515 B2 9/2005 Carlson et al.
7,032,662 B2 4/2006 Malone
7,033,975 B2 4/2006 Baran, Jr. et al.
7,086,484 B2 8/2006 Smith
7,249,009 B2 7/2007 Ferworn et al.
7,281,435 B2 10/2007 Sale et al.
7,289,942 B2 10/2007 Yang et al.
7,303,006 B2 12/2007 Stone
7,373,073 B2 5/2008 Kamp et al.
7,472,748 B2 1/2009 Gdanski et al.
7,485,471 B1 2/2009 Sun et al.
7,520,933 B2 4/2009 Park et al.
7,526,953 B2 5/2009 Goodwin et al.
7,588,827 B2 9/2009 Nie et al.
7,810,563 B2 10/2010 Buijse et al.
7,861,601 B2 1/2011 Sale et al.
7,875,654 B2 1/2011 Hong et al.
7,879,625 B1 2/2011 Boss
7,920,970 B2 4/2011 Zuo et al.
8,028,562 B2 10/2011 Shah et al.
8,062,418 B2 11/2011 Costantz et al.
8,148,477 B2 4/2012 Saita et al.
8,176,981 B2 5/2012 Savu et al.
8,177,422 B2 5/2012 Kjoller et al.
8,187,554 B2 5/2012 Panagiotou
8,269,501 B2 9/2012 Schmidt et al.
8,337,783 B2 12/2012 Locascio et al.
8,418,759 B2 4/2013 Moore et al.
8,507,844 B2 8/2013 Mazza
8,596,354 B2 12/2013 Hartshorne et al.
8,627,902 B2 1/2014 Hammer
8,629,089 B2 1/2014 Dams
8,638,104 B2 1/2014 Barber et al.
8,661,907 B2 3/2014 Davis et al.
8,722,812 B2 5/2014 Yabu et al.
8,816,689 B2 8/2014 Colombo et al.
8,821,806 B2 9/2014 Hersherwitz et al.
8,877,954 B2 11/2014 Giesenberg et al.
8,895,484 B2 11/2014 Stray
8,949,029 B2 2/2015 Nyhavn
8,969,261 B2 3/2015 Talingting Pabalan et al.
8,996,346 B2 3/2015 Zuo et al.
9,023,966 B2 5/2015 Zhang et al.
9,034,920 B2 5/2015 Lam et al.
9,050,655 B2 6/2015 Chou et al.
9,080,097 B2 7/2015 Gupta et al.
9,121,271 B2 9/2015 Shook
9,128,210 B2 9/2015 Pomerantz
9,133,709 B2 9/2015 Huh et al.
9,200,102 B2 12/2015 Baran, Jr. et al.
9,227,929 B2 1/2016 Winter et al.
9,279,771 B2 3/2016 Aizenberg et al.
9,284,833 B2 3/2016 Hewitt et al.
9,290,689 B2 3/2016 Lafitte et al.
9,296,851 B2 3/2016 Luettgen
9,322,056 B2 4/2016 McCann et al.
9,322,269 B2 4/2016 Matherly et al.
9,366,099 B2 6/2016 Ly
9,375,790 B2 6/2016 Murphy et al.
9,377,449 B2 6/2016 Tour et al.
9,481,764 B1 11/2016 Kinlen et al.
9,528,045 B2 12/2016 Kanj et al.
9,534,062 B2 1/2017 He et al.
9,592,555 B2 3/2017 Schut et al.
9,594,070 B2 3/2017 Rule et al.
9,624,422 B2 4/2017 Dams et al.
9,664,665 B2 5/2017 Gisolf et al.
9,696,270 B1 7/2017 Roy et al.
9,708,525 B2 7/2017 Suresh et al.
9,719,009 B2 8/2017 Jangda et al.
9,770,583 B2 9/2017 Gupta et al.
9,791,417 B2 10/2017 Irisawa et al.
9,809,740 B2 11/2017 Chakraborty et al.
9,873,622 B2 1/2018 Kang et al.
9,873,827 B2 1/2018 Chakraborty et al.
9,910,026 B2 3/2018 Zhang et al.
10,273,399 B2 4/2019 Cox
10,288,609 B2 5/2019 Brueckner et al.
10,308,865 B2 6/2019 Cox
10,308,895 B2 6/2019 Vidal et al.
10,316,873 B2 6/2019 Weitz et al.
10,392,555 B2 8/2019 Giro et al.
10,400,159 B2 9/2019 Gupta
10,421,894 B2 9/2019 Johnson et al.
10,436,003 B2 10/2019 Kim et al.
10,444,065 B2 10/2019 Schmidt et al.
10,458,207 B1 10/2019 Matringe et al.
10,487,259 B2 11/2019 Cox
10,611,967 B2 4/2020 Inan
10,858,931 B2 12/2020 Chen et al.
10,871,067 B2 12/2020 Nyhavn
10,895,497 B2 1/2021 Schmidt et al.
10,934,475 B2 3/2021 Ren et al.
10,961,443 B2 3/2021 Zhao
10,961,445 B2 3/2021 Ogle et al.
11,230,919 B2 1/2022 Ow et al.
2001/0036667 A1 11/2001 Tayebi
2002/0026000 A1 2/2002 Varadaraj et al.
2003/0220204 A1 11/2003 Baran et al.
2004/0108110 A1 6/2004 Zupanick et al.
2004/0143059 A1 7/2004 Cabrera et al.
2005/0080209 A1 4/2005 Blankenship et al.
2005/0252286 A1 11/2005 Ibrahim et al.
2006/0088476 A1 4/2006 Harder
2006/0105052 A1 5/2006 Acar et al.
2006/0120683 A1 6/2006 Kamp et al.
2007/0114030 A1 5/2007 Todd et al.
2007/0119244 A1 5/2007 Goodwin et al.
2007/0289740 A1* 12/2007 Thigpen ..... E21B 43/14
166/250.01
2008/0019921 A1 1/2008 Zhang
2008/0110253 A1 5/2008 Stephenson et al.
2008/0111064 A1 5/2008 Andrews et al.
2008/0206317 A1 8/2008 Johnsson et al.
2008/0220970 A1 9/2008 Martin
2009/0087911 A1 4/2009 Rogerio
2009/0087912 A1 4/2009 Ramos et al.

(56) References Cited

U.S. PATENT DOCUMENTS

| | | | |
|---|---|---|---|
| 2009/0173253 | A1 | 7/2009 | Roesch et al. |
| 2009/0174117 | A1 | 7/2009 | Winkler et al. |
| 2009/0248309 | A1 | 10/2009 | Nelville et al. |
| 2009/0253595 | A1 | 10/2009 | Qu et al. |
| 2009/0264321 | A1 | 10/2009 | Showalter et al. |
| 2009/0264768 | A1 | 10/2009 | Courtney |
| 2009/0277625 | A1 | 11/2009 | Bai et al. |
| 2010/0038086 | A1 | 2/2010 | Bunnell et al. |
| 2010/0049625 | A1 | 2/2010 | Biebesheimer et al. |
| 2010/0068821 | A1 | 3/2010 | St Germain |
| 2010/0092865 | A1 | 4/2010 | Kanno et al. |
| 2010/0200744 | A1 | 8/2010 | Pearce et al. |
| 2010/0224823 | A1 | 9/2010 | Yin et al. |
| 2010/0270020 | A1 | 10/2010 | Baran et al. |
| 2010/0290999 | A1 | 11/2010 | Kim |
| 2010/0305219 | A1 | 12/2010 | Granick et al. |
| 2010/0307745 | A1 | 12/2010 | Lafitte et al. |
| 2010/0314114 | A1 | 12/2010 | Moradi-Araghi et al. |
| 2011/0012331 | A1 | 1/2011 | Kim |
| 2011/0030949 | A1 | 2/2011 | Weaver et al. |
| 2011/0129424 | A1 | 6/2011 | Berkland et al. |
| 2011/0207231 | A1 | 8/2011 | Natan et al. |
| 2011/0239754 | A1 | 10/2011 | Dyer et al. |
| 2011/0257887 | A1 | 10/2011 | Cooper et al. |
| 2011/0260051 | A1 | 10/2011 | Preudhomme et al. |
| 2011/0275061 | A1 | 11/2011 | Weidemaier et al. |
| 2011/0320128 | A1 | 12/2011 | Shook |
| 2012/0026037 | A1 | 2/2012 | Thomson et al. |
| 2012/0062886 | A1 | 3/2012 | Piotti et al. |
| 2012/0092960 | A1 | 4/2012 | Gaston et al. |
| 2012/0115128 | A1 | 5/2012 | Miller |
| 2012/0135080 | A1 | 5/2012 | Bromberg et al. |
| 2012/0175120 | A1 | 7/2012 | Holcomb et al. |
| 2012/0190593 | A1 | 7/2012 | Soane et al. |
| 2012/0193578 | A1 | 8/2012 | Pan et al. |
| 2012/0257199 | A1 | 10/2012 | Liu et al. |
| 2012/0261617 | A1 | 10/2012 | Pan et al. |
| 2012/0325465 | A1 | 12/2012 | Hammer et al. |
| 2013/0017610 | A1 | 1/2013 | Roberts et al. |
| 2013/0040292 | A1 | 2/2013 | Lopez et al. |
| 2013/0084630 | A1 | 4/2013 | Rolland et al. |
| 2013/0084643 | A1 | 4/2013 | Commarieu et al. |
| 2013/0087020 | A1 | 4/2013 | Brutchey et al. |
| 2013/0087329 | A1 | 4/2013 | Hewitt et al. |
| 2013/0087340 | A1 | 4/2013 | Choens et al. |
| 2013/0109261 | A1 | 5/2013 | Koene |
| 2013/0126158 | A1 | 5/2013 | Gupta |
| 2013/0172853 | A1 | 7/2013 | McClain |
| 2013/0244914 | A1 | 9/2013 | Wu et al. |
| 2013/0259808 | A1 | 10/2013 | Chen et al. |
| 2013/0296453 | A1 | 11/2013 | Giesenberg et al. |
| 2013/0312970 | A1 | 11/2013 | Lafitte et al. |
| 2013/0341030 | A1 | 12/2013 | Brannon et al. |
| 2014/0036628 | A1 | 2/2014 | Hill et al. |
| 2014/0048694 | A1 | 2/2014 | Pomerantz |
| 2014/0060832 | A1 | 3/2014 | Mahoney et al. |
| 2014/0077121 | A1 | 3/2014 | Sun et al. |
| 2014/0120627 | A1 | 5/2014 | Rubino et al. |
| 2014/0122047 | A1 | 5/2014 | Saldivar et al. |
| 2014/0124196 | A1 | 5/2014 | Sunde et al. |
| 2014/0159715 | A1 | 6/2014 | McEwen-King |
| 2014/0186939 | A1 | 7/2014 | Peterman et al. |
| 2014/0190700 | A1 | 7/2014 | Tang et al. |
| 2014/0200511 | A1 | 7/2014 | Boyden |
| 2014/0208825 | A1 | 7/2014 | Holba et al. |
| 2014/0231077 | A1 | 8/2014 | Rivero et al. |
| 2014/0260694 | A1 | 9/2014 | Szlendak |
| 2014/0323363 | A1 | 10/2014 | Perriat |
| 2014/0360973 | A1 | 12/2014 | Yin et al. |
| 2015/0001385 | A1 | 1/2015 | Perriat et al. |
| 2015/0013983 | A1 | 1/2015 | Alwattari |
| 2015/0038347 | A1 | 2/2015 | Johnson et al. |
| 2015/0050741 | A1 | 2/2015 | Tour et al. |
| 2015/0079270 | A1 | 3/2015 | Wang et al. |
| 2015/0118501 | A1 | 4/2015 | Lu |
| 2015/0132543 | A1 | 5/2015 | Nouzille et al. |
| 2015/0132742 | A1 | 5/2015 | Thou et al. |
| 2015/0148269 | A1 | 5/2015 | Tamsilian |
| 2015/0153472 | A1 | 6/2015 | Tour |
| 2015/0159079 | A1 | 6/2015 | Huh et al. |
| 2015/0175876 | A1 | 6/2015 | Resasco et al. |
| 2015/0192436 | A1 | 7/2015 | Farhadiroushan et al. |
| 2015/0218435 | A1 | 8/2015 | Suresh et al. |
| 2015/0232747 | A1 | 8/2015 | Kanj et al. |
| 2015/0232748 | A1 | 8/2015 | Kanj et al. |
| 2015/0268370 | A1 | 9/2015 | Johnston et al. |
| 2015/0299369 | A1 | 10/2015 | Ausserre et al. |
| 2015/0337874 | A1 | 11/2015 | Park |
| 2015/0368547 | A1 | 12/2015 | Lesko et al. |
| 2015/0376493 | A1 | 12/2015 | Huh et al. |
| 2016/0003040 | A1 | 1/2016 | Jessheim et al. |
| 2016/0016166 | A1 | 1/2016 | Rolland et al. |
| 2016/0040514 | A1 | 2/2016 | Rahmani et al. |
| 2016/0061020 | A1 | 3/2016 | Sayarpour |
| 2016/0061790 | A1 | 3/2016 | Zhang |
| 2016/0075937 | A1 | 3/2016 | Cannan |
| 2016/0083641 | A1 | 3/2016 | Gamage |
| 2016/0097750 | A1 | 4/2016 | Van Herzen et al. |
| 2016/0129371 | A1 | 5/2016 | Black |
| 2016/0146662 | A1 | 5/2016 | Stokely et al. |
| 2016/0215030 | A1 | 7/2016 | Bressner |
| 2016/0251571 | A1 | 9/2016 | Agrawal et al. |
| 2016/0264846 | A1 | 9/2016 | Bennetzen et al. |
| 2016/0271513 | A1 | 9/2016 | Weitz |
| 2016/0304934 | A1 | 10/2016 | Matsuno |
| 2016/0340569 | A1 | 11/2016 | Belcher |
| 2017/0022804 | A1 | 1/2017 | Gupta et al. |
| 2017/0059668 | A1 | 3/2017 | Chang et al. |
| 2017/0067322 | A1 | 3/2017 | Wong |
| 2017/0173546 | A1 | 6/2017 | Cheng et al. |
| 2017/0199124 | A1 | 7/2017 | Bolduc et al. |
| 2017/0336528 | A1 | 11/2017 | Badri et al. |
| 2017/0350236 | A1 | 12/2017 | Shen et al. |
| 2017/0361376 | A1 | 12/2017 | Murugesan et al. |
| 2018/0171782 | A1 | 6/2018 | Cox et al. |
| 2018/0201644 | A1 | 7/2018 | Kulak et al. |
| 2018/0275114 | A1 | 9/2018 | Kosynkin et al. |
| 2018/0369808 | A1 | 12/2018 | Wronko |
| 2019/0016943 | A1 | 1/2019 | Ren et al. |
| 2019/0118175 | A1 | 4/2019 | Kim et al. |
| 2019/0118265 | A1 | 4/2019 | Nie et al. |
| 2019/0218907 | A1 | 7/2019 | Ow et al. |
| 2019/0226326 | A1 | 7/2019 | Ow et al. |
| 2019/0368336 | A1 | 12/2019 | Hammond et al. |
| 2019/0374916 | A1 | 12/2019 | Sherman et al. |
| 2019/0382648 | A1 | 12/2019 | Murugesan et al. |
| 2020/0032641 | A1 | 1/2020 | Kulyakhtin et al. |
| 2020/0116019 | A1 | 4/2020 | Ow et al. |
| 2020/0290879 | A1 | 9/2020 | Chang et al. |
| 2020/0377626 | A1 | 12/2020 | Ow et al. |
| 2020/0408089 | A1 | 12/2020 | Ow et al. |
| 2021/0018436 | A1 | 1/2021 | Ow et al. |
| 2021/0025858 | A1 | 1/2021 | Ow et al. |
| 2021/0080413 | A1 | 3/2021 | Eichmann et al. |
| 2021/0080414 | A1 | 3/2021 | Eichmann et al. |
| 2021/0107798 | A1 | 4/2021 | Wang |
| 2021/0396907 | A1 | 12/2021 | Wang |
| 2022/0065101 | A1 | 3/2022 | Poitzsch et al. |
| 2023/0141596 | A1 | 5/2023 | Wang et al. |
| 2023/0141819 | A1 | 5/2023 | Wang et al. |
| 2023/0144199 | A1 | 5/2023 | Wang et al. |
| 2023/0148198 | A1 | 5/2023 | Wang et al. |

FOREIGN PATENT DOCUMENTS

| | | |
|---|---|---|
| CA | 2941370 | 7/2018 |
| CA | 2916567 | 8/2019 |
| CN | 101475667 | 7/2009 |
| CN | 102649831 | 8/2012 |
| CN | 103160265 | 6/2013 |
| CN | 103267825 | 8/2013 |
| CN | 103275270 | 9/2013 |
| CN | 103352255 | 10/2013 |
| CN | 102586873 | 12/2014 |

(56) References Cited

FOREIGN PATENT DOCUMENTS

| | | | | |
|---|---|---|---|---|
| CN | 104616350 | | 5/2015 | |
| CN | 107915802 | | 4/2018 | |
| CN | 111303853 | | 6/2020 | |
| EA | 024705 | | 10/2016 | |
| EP | 0171978 | | 11/1990 | |
| EP | 1721603 | | 11/2006 | |
| EP | 2004573 | | 12/2008 | |
| EP | 2040075 | | 3/2009 | |
| EP | 2104082 | | 9/2009 | |
| EP | 1404776 | | 11/2012 | |
| EP | 2480625 | | 4/2013 | |
| EP | 2480626 | | 4/2013 | |
| EP | 3444028 | | 2/2019 | |
| FR | 2756046 | | 5/1998 | |
| FR | 2928484 | | 9/2009 | |
| GB | 2161269 | | 8/1988 | |
| GB | 2442745 | | 4/2011 | |
| GB | 2489714 | | 10/2012 | |
| GB | 2528716 | A * | 2/2016 | ..... C09K 8/03 |
| GB | 2569868 | | 7/2019 | |
| JP | 2005524849 | | 8/2005 | |
| JP | 2007514169 | | 5/2007 | |
| JP | 2008505259 | | 2/2008 | |
| JP | 2008524602 | | 7/2008 | |
| JP | 2009535060 | | 10/2009 | |
| JP | 2009540326 | | 11/2009 | |
| JP | 2015523073 | | 8/2015 | |
| KR | 20170131731 | | 11/2017 | |
| KR | 101852925 | | 4/2018 | |
| NO | 20140495 | | 6/2014 | |
| TW | 200643094 | | 12/2006 | |
| WO | WO 1999038931 | | 8/1999 | |
| WO | WO 2002102917 | | 12/2002 | |
| WO | WO 2003100214 | | 12/2003 | |
| WO | WO 2004095259 | | 11/2004 | |
| WO | WO 2004113677 | | 12/2004 | |
| WO | WO 2007124814 | | 11/2007 | |
| WO | WO 2008034553 | | 3/2008 | |
| WO | WO 2010019256 | | 2/2010 | |
| WO | WO 2010138914 | | 12/2010 | |
| WO | WO 2011035292 | | 3/2011 | |
| WO | WO 2011035294 | | 3/2011 | |
| WO | WO 2011063023 | | 5/2011 | |
| WO | WO 2011081681 | | 7/2011 | |
| WO | WO 2012052148 | | 4/2012 | |
| WO | WO 2012057634 | | 5/2012 | |
| WO | WO 2012154332 | | 11/2012 | |
| WO | WO 2012158478 | | 11/2012 | |
| WO | WO 2013142869 | | 9/2013 | |
| WO | WO 2014008496 | | 1/2014 | |
| WO | WO 2014014919 | | 1/2014 | |
| WO | WO 2014066793 | | 5/2014 | |
| WO | WO 2014096495 | | 6/2014 | |
| WO | WO 2014100275 | | 6/2014 | |
| WO | WO 2014179020 | | 11/2014 | |
| WO | WO 2014207075 | | 12/2014 | |
| WO | WO 2015020642 | | 2/2015 | |
| WO | WO 2015044446 | | 4/2015 | |
| WO | WO 2015058206 | | 4/2015 | |
| WO | WO 2015097116 | | 7/2015 | |
| WO | WO 2015200060 | | 12/2015 | |
| WO | WO 2016087397 | | 6/2016 | |
| WO | WO 2016105210 | | 6/2016 | |
| WO | WO 2016174413 | | 11/2016 | |
| WO | WO 2017011328 | | 1/2017 | |
| WO | WO 2017015120 | | 1/2017 | |
| WO | WO 2017136641 | | 8/2017 | |
| WO | WO 2017164822 | | 9/2017 | |
| WO | WO 2017205565 | | 11/2017 | |
| WO | WO 2017210424 | | 12/2017 | |
| WO | WO 2018031655 | | 2/2018 | |
| WO | WO 2018085504 | | 5/2018 | |
| WO | WO 2018175763 | | 9/2018 | |
| WO | WO 2018234431 | | 12/2018 | |
| WO | WO 2019027817 | | 2/2019 | |
| WO | WO 2019063100 | | 4/2019 | |
| WO | WO 2019066811 | | 4/2019 | |
| WO | WO 2020239649 | | 12/2020 | |
| WO | WO 2021092328 | | 5/2021 | |

OTHER PUBLICATIONS

"Method Development Guidelines: Solid Phase Extraction Using ISOLUTE® ENV+ for the Extraction of Aqueous Samples," Biotage, 2020, 3 pages.

"Optimizing Extraction of Multianalyte Suites from Water Samples Using Layered Solid Phase Extraction Columns," Biotage, Layered Solid Phase Extraction cols. 2016, Brochure, 4 pages.

"SPE columns, CHROMABOND HR-XAW, 85 µm, 1 mL/100 mg," Macherey-Nagel, available on or before Nov. 18, 2020, retrieved on Dec. 1, 2021, retrieved from URL <https://www.mn-net.com/us/spe-columns-chromabond-hr-xaw-85-m-1-ml/100-mg-730729>, 3 pages.

"Waters Corp Oasis WAX 6 cc Vac Cartridge, 500 mg Sorbent per Cartridge, 60 µm, 30/pk," Fisher Scientific, retrieved on Dec. 1, 2021, retrieved from URL <https://www.fishersci.com/shop/products/oasis-wax-cartridge-6cc-500mg/50466019>, 1 page.

Agenet et al., "Fluorescent Nanobeads: a First Step Toward Intelligent Water Tracers," SPE-157019, Society of Petroleum Engineers (SPE), presented at the SPE International Oilfield Nanotechnology Conference held in Noordwijk, the Netherlands, Jun. 12-14, 2012, 13 pages.

Agilent "Agilent's New Mixed-Mode Anion Exchange Polymer Solid Phase Extraction Cartridges: SampliQ SAX," Agilent Technologies, Inc. 2008, Brochure, 4 pages.

Alfazazi et al., "Screening of New HPAM Base Polymers for Applications in High Temperature and High Salinity Carbonate Reservoirs," SPE-192805-MS, Society of Petroleum Engineers (SPE), presented at Abu Dhabi International Petroleum Exhibition & Conference, Nov. 12-15, 2018, 17 pages.

Allard and Larpent, "Core-shell type dually fluorescent polymer nanoparticles for ratiometric pH-sensing," J. Polym. Sci., Part A: Polym. Chem. 46:18 (6206-6213), 2008, 8 pages.

Alley et al., "Analysis of Polychlonnated Biphenyls in Fatty Biological Matrixes by on-Line Supercritical Fluid Extraction and Supercritical Fluid Cleanup." Journal of AOAC International 78.4, Jul. 1995, 1051-1054, 4 pages.

Al-Muntasheri et al., "Nanoparticle-Enhanced Hydraulic-Fracturing Fluids: a Review," SPE185161-PA, Society of Petroleum Engineers (SPE), SPE Production & Operations 32:02, May 2017, 10 pages.

Anbari et al., "Microfluidic Model Porous Media: Fabrication and Applications," Nano Micro Small, Special Issue: Multi-Scale Pores and Channels, May 3, 2018, 14:18 (1703575), 15 pages.

Angeles-Martinez, "Utilization of Water Salinity as a Continuous Miscible Tracer in Waterflooding." Paper presented at the SPE Latin America Petroleum Engineering Conference, Caracas, Venezuela, Mar. 1992, 7 pages.

Anisimov, "The Use of Tracers for Reservoir Characterization," SPE 118862, Society of Petroleum Engineers (SPE), presented at SPE Middle East Oil and Gas Show and Conference, Mar. 15-18, 2009, 8 pages.

Annen et al., "A facile synthesis of dispersible NaCl nanocrystals," Dalton Transactions, Nov. 2009, 44: 9731-9734, 5 pages.

Armelao et al., "Design of luminescent lanthanide complexes: From molecules to highly efficient photo-emitting materials," Coordination Chemistry Reviews, 254: 487-505, Mar. 2010, 19 pages.

Armstrong et al., "Artificial opal photonic crystals and inverse opal structures—fundamentals and applications from optics to energy storage," Journal of Materials Chemistry C, May 2015, 3: 6109-6143, 35 pages.

Asadi et al., "Application of Chemical Tracers in IOR: a Case History," SPE-126029-MS, Society of Petroleum Engineers (SPE), presented at the SPE North African Technical Conference and Exhibition, Feb. 14-17, 2010, 11 pages.

Asano et al., "Development of paper-based microfluidic analytical device for iron assay using photomask printed with 3D printer for

(56) References Cited

OTHER PUBLICATIONS fabrication of hydrophilic and hydrophobic zones on paper by photolithography," Analytica Chimica Acta, 883:55-60, Apr. 9, 2015, 6 pages.
Aslan et al., "Fluorescent Core—Shell AG@$SiO_2$ Nanocomposites for Metal-Enhanced Fluorescence and Single Nanoparticle Sensing Platforms," JACS Communications, J. Am. Chem. Soc. 129: 1524-1525, Jan. 19, 2007, 2 pages.
Atarita et al., "Predicting Distribution of Total Organic Carbon (TOC) and S2 with Δ Log Resistivity and Acoustic Impedance Inversion on Talang Akar Formation, Cipunegara Sub Basin, West Java," Procedia Engineering, 2017, 170: 390-397, 8 pages.
Badgett et al., "Totalsynthese eines Neobetanidin-Derivates und des Neobetenamins," Helvetica Chimica Acta 53(2): 433-448, 1970, 16 pages, English Summary.
Bagaria et al., "Iron Oxide Nanoparticles Grafted with Sulfonated Copolymers are Stable in Concentrated Brine at Elevated Temperatures and Weakly Adsorb on Silica," ACS Applied Materials & Interfaces, 5(8): 3329-3339, Mar. 25, 2013, 11 pages.
Bala et al., "Interaction of Different Metal Ions with Carboxylic Acid Group: a Quantitative Study," The Journal of Physical Chemistry A, 111(28): 6183-6190, Jun. 2007, 8 pages.
Bao et al., "Luminescence properties of the co-luminescence groups of Sm—La-pyridyl carboxylic acids," Journal of Rare Earths 30(4): 320-324, Apr. 2012, 5 pages.
Behnke et al., "Encapsulation of Hydrophobic Dyes in Polystyrene Micro- and Nanoparticles via Swelling Procedures." J. Fluoresc. 21(3): 937-944, 2011, 8 pages.
Benninger et al., "Time-resolved fluorescence imaging of solvent interaction in microfluidic devices," Optics Express, Sep. 2005, 11 pages.
Biot et al., "Temperature analysis in hydraulic fracturing," Journal of Petroleum Technology, vol. 39, No. 11, Nov. 1987, 9 pages.
Blachier et al., "Adsorption of polyamine on clay minerals" Journal of Colloid and Interface Science, 336, Aug. 2009, 599-606, 8 pages.
Blanz et al., "Nuclear Magnetic Resonance Logging While Drilling (NMR-LWD): From an Experiment to a Day-to-Day Service for the Oil Industry," Diffusion Fundamentals, 2010, 14(2), 5 pages.
Borrini et al., "Water Soluble PDCA Derivatives for Selective Ln(III)/An(III) and Am(III)/Cm(III) Separation," Solvent Extraction and Ion Exchange 33(3): 224-235, Oct. 2014, 30 pages.
Boyjoo et al., "Synthesis of micro and nano-sized calcium carbonate particles and their applications," Journal of Materials Chemistry A, 2014, 2: 14270-14288, 19 pages.
Brichart et al., "The Use of Fluorescent Tracers for Inhibitor Concentration Monitoring Useful for Scale Inhibitor," IPTC-17933-MS, International Petroleum Technology Conference, presented at the International Petroleum Technology Conference held in Kuala Lumpur, Dec. 10-12, 2014, 8 pages.
Buchgraber et al., "Creation of a dual-porosity micromodel for pore-level visualization of multiphase flow," J. Petrol. Sci. Eng., 2012, 86-87: 27-38, 12 pages.
Bunzli and Piguet, "Taking advantage of luminescent lanthanide ions," Chemical Society Reviews, 34(12): 1048-1077, Sep. 2005, 30 pages.
Cahill et al., "Nanoscale Thermal Transport II," Applied Physics Reviews 1.1, 2014, 46 pages.
Cahill et al., "Nanoscale thermal transport," Journal of applied physics vol. 93, No. 2, Jan. 2003, 28 pages.
Cao et al., "Solute reactive tracers for hydrogeological applications: a short review and future prospects." Water 12.3, Mar. 2020, 21 pages.
Chang et al., "Magnetic SERS Composite Nanoparticles for Microfluidic Detection," 251st ACS National Meeting, Mar. 13-17, 2016, 1 pages, abstract only.
Chemspider.com [online], "Structure Search" Mar. 2008, [retrieved on Feb. 15, 2022], retrieved from : URL <http://www.chemspider.com/structuresearch.aspx>, 1 page.
Chen et al., "Aggregation Kinetics of Alginate-Coated Hematite Nanoparticles in Monovalent and Divalent Electrolytes," Environmental Science & Technology, 40(5): 1516-1523, Mar. 2006, 8 pages.
Chen et al., "Analysis of the solution conformations of T4 lysozyme by paramagnetic NMR spectroscopy," The Royal Society of Chemistry, Physical Chemistry Chemical Physics (PCCP) 18(8): 5850-5859, 2016, 10 pages.
Chen et al., "Hydration Repulsion between Carbohydrate Surfaces Mediated by Temperature and Specific Ions" Scientific Reports, vol. 6, Jun. 23, 2016, 10 pages.
Chen et al., "Impact of Irreversible Retention on Tracer Deployments; Constraining Novel Material Deployments," SPE 188890-MS, Society of Petroleum Engineers (SPE), presented at the SPE Abu Dhabi International Petroleum Exhibition and Conference, Nov. 2017, 8 pages.
Chen et al., "Improved Reservoir History Matching and Production Optimization with Tracer Data," SPE 191523-MS, Society of Petroleum Engineers (SPE), presented at the SPE Annual Technical Conference and Exhibition, Sep. 2018, 15 pages.
Chen et al., "Semicontinuous Monomer-Starved Emulsion Polymerization as a Means to Produce Nanolatexes: Analysis of Nucleation Stage," Langmuir, 29: 5650-5658, 2013, 9 pages.
Chen et al., "Synthesis of ordered lemellar supermicroporous silica with rigid neutral and long-chain cationic composite templating route," Plos One, Apr. 2019, 14(4): 3-5, 13 pages.
Chen et al., "Upconversion Nanoparticles: Design, Nanochemistry, and Applications in Theranostics" Chem. Rev, 114(10), Mar. 2014, 5161-5214, 54 pages.
Chen et al., "FITC functionalized magnetic core-shell $Fe_3O_4$/Ag hybrid nanoparticle for selective determination of molecular biothiols," Sensorts and Actuators B: Chemical 193: 857-863, 2014, 7 pages.
Cheraghian, "Application of nano-particles of clay to improve drilling fluid" Int. J. Nanosci. Nanotechnol., 13, Jun. 2017, 177-186, 10 pages.
Christy et al., "Characterization of Natural Organic Matter by Pyrolysis/GC-MS," Environment International, 25, 1999, 9 pages.
Chuang et al., "Ultra-sensitive in-situ detection of novel near-infrared persistent luminescent tracer nanoagents in crude oil-water mixtures," a natureresearch journal, Scientific Reports, Jun. 15, 2016, 5 pages.
Clark et al., "Water-Soluble Fluorochemical Surfactant Well Stimulation Additives," SPE9008, Society of Petroleum Engineers (SPE), Journal of Petroleum Technology, 34:07, Jul. 1982, 5 pages.
Clough et al., "Characterization of Kerogen and Source Rock Maturation Using Solid-State NMR Spectroscopy," Energy & Fuels, 2015, 29(10): 6370-6382, 42 pages.
Coates et al., "Enhancement of luminescence of europium(m) ions in water by use of synergistic chelation. Part 1.1:1 and 2:1 complexes," J. Chem. Soc, Perkin Trans. 2 (1275-1282), Jan. 1996, 8 pages.
Cole et al., "Polyethylene Glycol Modified, Cross-Linked Starch-Coated Iron Oxide Nanoparticles for Enhanced Magnetic tumor Targeting," Biomaterials, 32:8 (2183-2193), Mar. 1, 2011, 11 pages.
coleparmer.com [online] "Kinesis TELOS® Multilayer SPE Columns," Cole-Parmer, available on or before 2021, retrieved on Nov. 17, 2021, retrieved from URL<https://www.coleparmer.com/p/kinesis-telos-multilayer-spe-columns/71662>, 3 pages.
Constantin and Davidson, "Lamellar La mesophases doped with inorganicnanoparticles," MINIREVIEW, Chem. Phys. Chem. 15: 1270-1282, 2014, 12 pages.
Corning Incorporated, "12.10G1 Fluidic Modules Description," in 09-CD, MG1 HP Instruction Manual, 5 ed.; Corning, Ed. 78-79, 2016, 2 pages.
Corning, "The future flows through Corning Advanced Flow-Reactors," G1 Reactor. Corning, Ed. 2016, 3 pages.
Cox et al., "Pyrolyzable Nanoparticle Tracers for Environmental Interrogation and Monitoring," ACS Appl. Mater. Interfaces, 9(15), 13111-13120, 2017, 10 pages.
Cubillos et al., "The Value of Inter-well and Single Well Tracer Technology for De-Risking and Optimizing a CEOR Process—

(56) References Cited

OTHER PUBLICATIONS

Caracara Field Case," SPE 174394-MS, Society of Petroleum Engineers (SPE), presented at the EUROPEC 2015, Jun. 1-4, 2015, 19 pages.
Cui et al., "A Combined Physical-Chemical Polymerization Process for Fabrication of Nanoparticle-Hydrogel Sensing Materials," Macromolecules 2012, 45 (20), 8382-8386, 5 pages.
Das et al., "Molecular Fluorescence, Phosphorescence, and Chemiluminescence Spectrometry," American Chemical Society (ACS Publications), Analytical Chemistry 84: S7-625, Nov. 3, 2011, 29 pages.
Deans, "Using Chemical Tracers to Measure Fractional Flow and Saturation In-Situ," SPE-7076, Society of Petroleum Engineers (SPE), presented at SPE Symposium on improved Methods of Oil Recovery, Apr. 16-17, 1978, 10 pages.
Deschamps et al., "Drilling to the Extreme: the Micro-Coring Bit Concept," IADC/SPE 115187, Society of Petroleum Engineers (SPE), International Association of Drilling Contractors (IADC), presented at the IADC/SPE Asia Pacific Drilling Technology Conference and Exhibition, Aug. 25-27, 2008, 12 pages.
Desmette et al., "Drilling Hard and Abrasive Rock Efficiently, or Generating Quality Cuttings? You No Longer Have to Choose . . . ," SPE 116554, Society of Petroleum Engineers (SPE), presented at the 2008 SPE Annual Technical Conference and Exhibition, Sep. 21-24, 2008, 19 pages.
Doda et al., "Investigation of Alkali Resistant Polymer for Improved Heavy Oil Recovery," SPE 165514, Society of Petroleum Engineers (SPE), presented at SPE Heavy Oil Conference—Canada, Jun. 11-13, 2013, 15 pages.
Du and Guan, "Interwell tracer tests: lessons learned from past field studies," SPE 93140-MS, Society of Petroleum Engineers (SPE), presented at the SPE Asia Pacific Oil and Gas Conference and Exhibition, Apr. 5-7, 2005, 9 pages.
Duan et al., "Review article: Fabrication of nanofluidic devices," Biomicrofluidics, Mar. 2013, 7:2 (026501), 42 pages.
Ducros, "Source Rocks of the Middle East," Source Rock Kinetics: Goal and Perspectives. AAPG Geosciences Technology Workshop, Jul. 2016, 30 pages.
Dugstad, "Chapter 6: Well-to-well tracer tests," in Petroleum Engineering Handbook, 5: 651-683, 2007, 31 pages.
Dung et al., "Structural and magnetic properties of starch coated magnetite nanoparticles" Journal of Experimental Nanoscience, 4, Sep. 2009, 259-267, 9 pages.
Edwards et al., "Extending the distance range accessed with continuous wave EPR with Gd3+ spin probes at high magnetic fields," The Royal Society of Chemistry, Physical Chemistry Chemical Physics (PCCP) 15:27 (11313-11326), 2013, 14 pages.
El-Aneed et al., "Mass Spectrometry, Review of the Basics: Electrospray, MALDI, and Commonly Used Mass Analyzers," Applied Spectroscopy Reviews 44:3 (210-230), Mar. 16, 2009, 22 pages.
Esfahani et al., "Quantitative nanoscale mapping of three-phase thermal conductivities in filled skutterudites via scanning thermal microscopy," Nature Science Review, vol. 5, Issue 1, Feb. 2017, 31 pages.
Esmaeilzadeh et al., "Effect of ZrO2 nanoparticles on the interfacial behavior of surfactant solutions at airwater and n-heptane-water interfaces," Fluid Phase Equilibria, 2014, 361, 289-295, 7 pages.
Esumi et al., "Interaction between Zwitterionic Fluorocarbon and Anionic Surfactants in Aqueous Solutions," Langmuir, 9(358-360), 1993, 3 pages.
Fernández et al., "Evaluation of Cationic Water-Soluble Polymers With Improved Thermal Stability," SPE 93003, Society of Petroleum Engineers (SPE), presented at SPE International Symposium on Oilfield Chemistry, Society of Petroleum Engineers, Feb. 2005, 13 pages.
Fichtel et al., "A highly sensitive HPLC method for determination of nanomolar concentrations of dipicolinic acid, a characteristic constituent of bacterial endospores," Journal of Microbiological Methods, 2007, 70: 319-327, 9 pages.
Flury et al., "Dyes as tracers for vadose zone hydrology." Reviews of Geophysics 41.1, Mar. 2003, 37 pages.
Freeze and Cherry, "Chapter 9: Groundwater Contamination," in Groundwater, Englewood Cliffs, NJ: Prentice-Hall, Inc., 1979, 80 pages.
Gaillard et al., "New Water Soluble Anionic NVP Acrylamide Terpolymers for Use in Harsh EOR Conditions," SPE-169108-MS, Society of Petroleum Engineers (SPE), presented at SPE Improved Oil Recovery Symposium, Apr. 12-14, 2014, 18 pages.
Gaillard et al., "Selection of Customized Polymers to Enhance Oil Recovery from High Temperature Reservoirs," SPE-177073-MS, presented at the SPE Latin American and Caribbean Petroleum Engineering Conference, Society of Petroleum Engineers, Nov. 2015, 15 pages.
Galdiga and Greibrokk, "Ultra-trace determination of fluorinated aromatic carboxylic acids in aqueous reservoir fluids using solid-phase extraction in combination with gas chromatography-mass spectrometry," Journal of Chromatography A 793:2 (297-306), Jan. 16, 1998, 10 pages.
Gao et al., "A Surface Functional Monomer-Directing Strategy for Highly Dense Imprinting of TNT at Surface of Silica Nanoparticles," JACS Communications, Journal of American Chemical Society 129:25 (7859-7866), Jun. 2007, 8 pages.
Gardiner et al., "Chapter 1: Introduction to Raman Scattering," in Practical Raman Spectroscopy, Springer-Verlag, 1989, 9 pages.
Ge et al., "Fluorescence modified chitosan coated magnetic nanoparticles for high-efficiency cellular imaging" Nanoscale Res. Lett, 4, Jan. 2009, 287-295, 9 pages.
George et al., "Modified Dipicolinic Acid Ligands for Sensitation and Europium (III) Luminescence," Inorganic Chemistry 45:4 (1739-1744), Feb. 1, 2006, 6 pages.
Georgi, et al., "Advances in Cuttings Collection and Analysis," SPWLA 34th Annual Logging Symposium, Jun. 13-16, 1993, 20 pages.
Gerami et al., "Microfluidics for Porous Systems: Fabrication, Microscopy and Applications," Transport in Porous Media, 2019, 130: 277-304, 28 pages.
Ghanem et al., "Investigation of Fluorescent Dyes as Partitioning Tracers for Subsurface Nonaqueous Phase Liquid (NAPL) Characterization," Journal of Environmental Engineering ASCE, Aug. 2003, 5 pages.
Goerke et al., "Analysis of the Transfer of Radical Copolymerisation Systems from Semi-batch to Continuous Plants," in 12th International Symposium on Process Systems Engineering and 25th European Symposium on Computer Aided Process Engineering, Elsevier B.V, Copenhagen, Denmark, 2015, 6 pages.
Gogoi et al., "Review on microfluidic studies for EOR application," Journal of Petroleum Exploration and Production Technology, Sep. 2019, 9(3): 2263-2277, 15 pages.
Gordon-Grossman et al., "W-Band pulse EPR distance measurements in peptides using Gd3+-dipicolinic acid derivatives as spin labels," Physical Chemistry Chemical Physics 13:22 (10771-10780), 2011, 10 pages.
Greenkorn, "Experimental Study of Waterflood Tracers," SPE-169, Society of Petroleum Engineers (SPE), Journal Petroleum Technology, 14(1), Jan. 1962, 6 pages.
Grutzke et al., "Heptacoordinate Heteroleptic Salan (ONNO) and Thiosalan (OSSO) Titanium(IV) Complexes: Investigation of Stability and Cytotoxicity," American Chemical Society (ACS Publications), Inorganic Chemistry 54:14 (6697-6706), Jul. 2015, 10 pages.
Guo et al., "Crystallization in a Mixture of Solvents by Using a Crystal Modifier: Morphology Control in the Synthesis of Highly Monodisperse CaCO3 Microspheres," Angew. Chem. Int. Ed. 2006, 45:3977-3981, 5 pages.
Hagoot, "The response of interwell tracer tests in watered-out reservoirs," SPE 11131-MS, Society of Petroleum Engineers (SPE), presented at the 57th Annual Fall Technical Conference and Exhibition of the Society of Petroleum Engineers of AIME, Sep. 1982, 21 pages.
Han et al., "Application of Silver-Coated Magnetic Microspheres to a SERS-Based Optofluidic Sensor," American Chemical Society

(56) References Cited

OTHER PUBLICATIONS (ACS Publications), The Journal of Physical Chemistry (JPCC) 115: 6290-6296, Mar. 7, 2011, 7 pages.
Hansch et al., "Comparative QSAR: Understanding Hydrophobic Interactions," American Chemical Society, 1995, Chapter 19, 9 pages.
Hardy et al., "A novel fluorescent tracer for real-time tracing of clay transport over soil surfaces" Catena, 141, Jun. 2016, 39-45, 7 pages.
He et al., "Luminescent Europium Chelates Synthesis and Fluorescence Properties," Sensors and Materials 19:2 (123-132), 2007, 10 pages.
He et al., "One-pot Facile Synthesis of Janus Particles with Tailored Shape and Functionality," Electronic Supplementary Material (ESI) for Chemical Communications, The Royal Society of Chemistry, 2011, 17 pages.
Hindle et al., "Dipicolinic acid (DPA) assay revisited and appraised for spore detection," Analyst, 1999, 124: 1599-1604, 6 pages.
Holm et al., "Synthesis, Characterization, and Light-Induced Spatial Charge Separation in Janus Graphene Oxide," American Chemical Society (ACS Publications), Chemistry of Materials (CM) 30: 2084-2092, 2018, 9 pages.
hoteng.com [online], "Microfluidic Solutions for IOR/EOR Optimisation: Rapid and Cost Efficient EOR Screening using a Rock-on-a-Chip Approach," HOT Engineering GmbH, retrieved from URL <https://www.hoteng.com/microfluidic-solutions/#1457967643112-9de392c4-0c28>, retrieved on Jun. 2, 2020, available on or before Mar. 2019, 8 pages.
Hou et al., "Recent advances in colloidal photonic crystal sensors: Materials, structures and analysis methods," Nano Today, 2018, 22, 132-144, 13 pages.
Hu et al., "Fabrication, properties and applications of Janus particles," Chem. Soc. Rev. 41:11 (4356-4378), 2012, Feb. 2012, 23 pages.
Hu et al., "Smart Liquid SERS Substrates based on Fe3O4/Au Nanoparticles with Reversibly Tunable Enhancement Factor for Practical Quantitative Detection," Scientific Report 4: 7204 (1-10), Nov. 2014, 10 pages.
Huseby et al., "Assessing EOR potential from partitioning tracer data," SPE 172808-MS, Society of Petroleum Engineers (SPE), presented at the SPE Middle East Oil and Gas Show and Conference, Mar. 2015, 15 pages.
Huseby et al., "High Quality Flow Information from Tracer Data," SPE-169183-MS, Society of Petroleum Engineers (SPE), presented at the SPE Bergen One Day Seminar, Apr. 2, 2014, 9 pages.
Hutchins et al., "Aqueous Tracers for Oilfield Applications," SPE-21049, Society of Petroleum Engineers (SPE), presented at SPE International Symposium on Oilfield Chemistry, Feb. 20-22, 1991, 9 pages.
Invitrogen, "Fluorophores and Their Amine-Reactive Derivatives" Molecular Probs Handbook, a Guide to Fluorescent Probes and Labeling Technologies, 11th Edition, 2010, 88 pages.
Jangda et al., "Evaluation of Fluorosurfactant Performance with Super-Critical CO2 Flooding for High Salinity Carbonate Reservoirs," SPE-169725-MS, presented at the SPE EOR Conference at Oil and Gas West Asia, Society of Petroleum Engineers, Mar. 2014, 14 pages.
Jenkins et al., "Ultratrace Determination of Selected Lanthanides by Luminescence Enhancement," Analytical Chemistry 68:17 (2974-2980), Sep. 1, 1996, 7 pages.
Jun et al., "Multifunctional Silver-Embedded Magnetic Nanoparticles as SERS Nanoprobes and Their Applications," Wiley-VCH Verlag GmbH& Co. KGaA, Weinheim, Small 6:1 (119-125), Jan. 4, 2010, 7 pages.
Junkers, "Precision Polymer Design in Microstructured Flow Reactors: Improved Control and First Upscale at Once," Macromol. Chem. Phys. 218: 1600421-1600421, 2016, 9 pages.
Kaushik et al., "Gd(III) and Mn(II) complexes for dynamic nuclear polarization: small molecular chelate polarizing agents and applications with site-directed spin labeling of proteins," The Royal Society of Chemistry, Physical Chemistry Chemical Physics (PCCP) 18:39 (27205-27218), 2016, 36 pages.
Khalil et al., "Organic dye for subsea flowline assessment." SPE International Symposium on Oilfield Chemistry. OnePetro, Feb. 1999, 7 pages.
Khan et al., "Optimizing waterflood management in a giant UAE carbonate oil field using simulation-based streamlines," SPE 171777-MS, Society of Petroleum Engineers (SPE), presented at the Abu Dhabi International Petroleum Exhibition and Conference, Nov. 10-13, 2014, 9 pages.
Klapetek, "Chapter 11: Thermal Measurements," Quantitative Data Processing in Scanning Probe Microscopy: SPE Applications for Nanometrology, 2018, 26 pages.
Kneipp et al., "Single Molecule Detection Using Surface-Enhanced Raman Scattering (SERS)," Physical Review Letters, American Physical Society 78:9, Mar. 3, 1997, 4 pages.
Knowles et al., "Zwitterion Functionalized Silica Nanoparticle Coatings: the Effect of Particle Size on Protein, Bacteria, and Fungal Spore Adhesion," Langmuir, 35(5): 1335-1345, 2019, 11 pages.
Koelmans et al., "Chapter 12 in Marine Anthropogenic Litter" Springer Nature, 2015, 16 pages.
Kong et al., "Microfluidic diatomite analytical devices for illicit drug sensing with ppb-level sensitivity," Sensors and Actuators, B, 259, 2018, 9 pages.
Kornberger and Thiele, "Experiences with an Efficient Rate-Management Approach for the 8th Tortonian Reservoir in the Vienna Basin," SPE 166393-PA, Society of Petroleum Engineers (SPE), presented at the SPE Annual Technical Conference and Exhibition, Sep. 30-Oct. 2, 2013, SPE Reservoir Evaluation and Engineering 17:2, May 2014, 12 pages.
Kosynkin and Alaskar, "Oil Industry First Interwell Trial of Reservoir Nanoagent Tracers," SPE 181551-MS, Society of Petroleum Engineers (SPE), presented at the SPE Annual Technical Conference and Exhibition, Sep. 2016, 15 pages.
Kramer, "Water-Soluble Dendritic Architectures with Carbohydrate Shells for the Templation and Stabilization of Catalytically Active Metal Nanoparticles," published by ACS, Macromolecules, 38:20 (8308-8315), Aug. 27, 2005, 8 pages.
Kulawardana et al., "Rheology and Transport of Improved EOR Polymers under Harsh Reservoir Conditions," SPE 154294, Society of Petroleum Engineers (SPE), presented at the SPE Improved Oil Recovery Symposium, Apr. 14-18, 2012, 14 pages.
Labbe et al., "Development of metal-chelating inhibitors for the Class II fructose 1,6-bisphosphate (FBP) aldolase," Journal of Inorganic Biochemistry 112: 49-58, Jul. 2012, 10 pages.
Lachowicz et al., "Biocompatible and fluorescent superparamagnetic iron oxide nanoparticles with superior magnetic properties coates with charged polysaccharide derivatives" Colloids and Surfaces B: Biointerfaces, 2017, 150, 402-407, 18 pages.
Larsen et al., "Efficient Synthesis of 4,7-Diamino Substituted 1,10-Phenanthroline-2,9-dicarboxamides," Organic Letters, 13:13 (3546-3548), Jul. 1, 2011, 3 pages.
Lee et al., "Site-Selective In Situ Grown Calcium Carbonate Micromodels with Tunable Geometry, Porosity, and Wettability," Advanced Functional Materials Interfaces, 2016, 10 pages.
Lehner et al., "Emergence of nanoplastic in the environment and possible impact on human health." Environmental science & technology 53.4, Jan. 2019, 1748-1765, 18 pages.
Levitt et al., "Selection and Screening of Polymers for Enhanced-Oil Recovery," SPE 113845, Society of Petroleum Engineers (SPE), presented at the SPE Symposium on Improved Oil Recovery, Apr. 19-23, 2008, 18 pages.
Lewan, "Evaluation of petroleum generation by hydrous pyrolysis experimentation," Phil. Trans. R. Soc. Lond. A, 1985, 315: 123-134, 13 pages.
Lewan, "Experiments on the role of water in petroleum formation," Geochimica et Cosmochimica Acta, Pergamon, 1997, 61:17 (3691-3723), 33 pages.
Li et al., "An amino-endcapped octadecylsilane silica-based mixed-mode stationary phase for the simultaneous separation of neutral and ionizable components in fixed-dose combinations." Analytical Methods 11.30, 2019, 3898-3909, 12 pages.

(56) References Cited

OTHER PUBLICATIONS

Li et al., "Automated Femtoliter Droplet-Based Determination of Oil-Water Partition Coefficient," Anal. Chem., 91, 10371, 2019, 5 pages.
Li et al., "Long persistent phosphors—from fundamentals to applications" Chem. Soc. Rev., 45(8), Apr. 2016, 2090-2136, 48 pages.
Li et al., "Magic Angle Spinning NMR Structure Determination of Proteins from Pseudocontact Shifts," JACS Communications, Journal of the American Chemical Society 135:22 (8294-8303), May 2013, 10 pages.
Li et al., "Superparamagnetic Iron Oxide Nanoparticles as MRI contrast agents for Non-invasive Stem Cell Labeling and Tracking" Theranostics, Jul. 2013, 3(8):595-615, 21 pages.
Li et al., "Thiol-ene reaction: a versatile tool in site-specific labelling of proteins with chemically inert tags for paramagnetic NMR," The Royal Society of Chemistry, Chemical Communications, Cambridge, United Kingdom 48:21 (2704-2706), 2012, 18 pages.
Liang et al., "Janus hollow spheres by emulsion interfacial self-assembled sol-gel process," Chemical Communications, Jan. 2011, 47(4): 1231-1233, 3 pages.
Liu et al., "Biological regeneration of manganese (IV) and iron (III) for anaerobic metal oxide-mediated removal of pharmaceuticals from water" Chemosphere 208, May 2018, 122-130, 43 pages.
Liu et al., "Photostimulated near-infrared persistent luminescence as a new optical read-out from Cr3+-doped LiGa5O8" Scientific Reports 3, Article 1554, Mar. 2013, 9 pages.
Liu et al., "Separation of polyethylene glycols and their fluorescein-labeled compounds depending on the hydrophobic interaction by high-performance liquid chromatography." Journal of Chromatography A 1129.1, Sep. 2006, 61-66, 6 pages.
Lomstein and Jorgensen, "Pre-column liquid chromatographic determination of dipicolinic acid from bacterial endospores," Limnology and Oceanography: Methods, Apr. 2012, 10:4, 227-233, 14 pages.
Lu et al., "Quantitative prediction of seismic rock physics of hybrid tight oil reservoirs of the Permian Lucaogou Formation, Junggar Basin, Northwest China," Journal of Asian Earth Sciences, 2019, 178: 216-223, 8 pages.
Luo et al., "Nanofluid of graphene-based amphiphilic Janus Nanosheets for tertiary or enhanced oil recovery: high performance at low concentration," Proceedings of the National Academy of Sciences of USA, PNAS, vol. 113, No. 28, Jul. 12, 2016, 17 pages.
Luo et al., "Secondary Oil Recovery Using Graphene-Based Amphiphilic JanusNanosheet Fluid at an Ultralow Concentration," American Chemical Society (ACS Publications), Industrial & Engineering Chemistry Research (I&EC Research), 56: 11125-11132, Sep. 2017, 25 pages.
Mahdavi et al., "Preparation, Characterization, and Application of Polyacrylamide-Polystyrene/Bentonite Nanocomposite as an Effective Immobilizing Adsorbent for Remediation of Soil" Chemistry Select, 5, Apr. 2020, 4538-4547, 12 pages.
Mahmoudi et al., "Superparamagnetic iron oxide nanoparticles development surface modification and applications in chemotherapy" Advanced Drug Delivery Reviews, Jan. 2011, 63, 24-46, 23 pages.
Manna et al, "Complexation behavior of trivalent actinides and lanthanides with 1,10-phenanthroline-2,9-dicarboxylic acid based ligands: insight from density functional theory," Physical Chemistry Chemical Physics (PCCP) 14:31 (11060), Jan. 1, 2012, 10 pages.
Mao et al., "Chemical and nanometer-scale structure of kerogen and its change during thermal maturation investigated by advanced solid-state 13C Nmr spectroscopy," Geochimica et Cosmochimica Acta, 2010, 74(7): 2110-2127, 18 pages.
Marais et al., "Time-Resolved Fluorescence for Real-Time Monitoring of Both Scale and Corrosion Inhibitors: a Game-Changing Technique," SPE 179867, Society of Petroleum Engineers (SPE), presented at the SPE International Oilfield Scale Conference and Exhibition held in Aberdeen, Scotland, May 11-12, 2016 11 pages.
Marchetti et al., "Fluorous affinity chromatography for enrichment and determination of perfluoroalkyl substances," American Chemical Society (ACS Publications), Annual Review of Analytical Chemistry 84: 7138-7145, Jul. 19, 2012, 8 pages.
Marine et al., "Partition Coefficient Measurements in Picoliter Drops Using a Segmented Flow Microfluidic Device," Anal. Chem., 81, 1471, 2009, 6 pages.
Martinez et al., "Chapter 9: Polysaccharide-based Nanoparticles for Controlled Release Formulations," in the Delivery of Nanoparticles, 185-222, May 2012, 39 pages.
Martini et al., "How to Monitor Scale Inhibitor Squeeze using Simple TRF Tracers," SPE-173768-MS, Society of Petroleum Engineers (SPE), presented at the SPE International Symposium on Oilfield Chemistry held in the Woodlands, Texas, Apr. 13-15, 2015, 8 pages.
Mattsson et al., "Nanoplastics in the aquatic environment." Microplastic contamination in aquatic environments, Jan. 2018, 379-399, 11 pages.
McGrail et al., "Selective mono-facial modification of grapheneoxide nanosheets in suspension," The Royal Society of Chemistry, Chem. Commun, 52: 288-291, 2016, 5 pages.
McWilliams et al., "Fluorescent surfactants from common dyes-rhodamine B and eosin Y." Pure and Applied Chemistry 92.2, Feb. 2020, 265-274, 15 pages.
Melton et al., "Complexes of Greatly Enhanced Thermodynamic Stability and Metal Ion Size-Based Selectivity, Formed by the Highly Preorganized Non-Macrocyclic Ligand 1,10-Phenanthroline-2,9-dicarboxylic Acid: a Thermodynamic and Crystallographic Study," Inorganic Chemistry 45:23 (9306-9314), Nov. 1, 2006, 9 pages.
Meyer et al., "Identification of Source Rocks on Wireline Logs by Density/Resistivity and Sonic Transit Time/Resistivity Crossplots," AAPG Bulletin, 1984, 68(2): 121-129, 9 pages.
Micronit Microfluidics BV., "Example chip drawing," retrieved on May 9, 2008, retrieved from URL <https://www.micronit.com>, 1 page.
micronit.com [online], "Enhanced oil recovery, " retrieved from URL <https://www.micronit.com/products/enhanced-oil-recovery.html>, retrieved on Mar. 10, 2020, 5 pages.
micronit.com [online], "Lab-on-a-chip and MEMS Solutions," retrieved from URL <https://www.micronit.com/>, retrieved on Jun. 2, 2020, available on or before Mar. 19, 2018 via wayback machine URL <https://web.archive.org/web/20180319182410/https://www.micronit.com/>, 7 pages.
Miller and McQuade, "5 Synthesis of Materials I Flow—Principles and Practice," in De Gruyter et al., Flow Chemistry, 2: 133-160, 2014, Part II, Chapter 5, 28 pages.
Mohamed et al., "Reaction screening in continuous flow reactors," J. Tetrahedron Letters, 57: 3965-3977, 2016, 12 pages.
Morse et al., "Enhanced Reaction Efficiency in Continuous Flow," Isr. J. Chem, 57:218-227, Apr. 2017, 14 pages.
Moyner et al., "The Application of Flow Diagnostics for Reservoir Management," Society of Petroleum Engineers (SPE), SPE Journal, Apr. 2015, 18 pages.
Muller and Seubert, "Ultra trace determination of fluorobenzoic acids in tap and reservoir water using solid-phase extraction and gas chromatography-mass spectrometry," Journal of Chromatography A, 1260: 9-15, Oct. 2012, 7 pages.
Musyanovych et al., "Preparation of Biodegradable Polymer Nanoparticles by Miniemulsion Technique and Their Cell Interactions," Macromolecular Bioscience, 8:2, Feb. 11, 2008, 13 pages.
Nahum et al., "Evaluation of Octanol-Water Partition Coefficients by Using High-Performance Liquid Chromatography," Journal of Chromatography, Elsevier Scientific Publishing Company, 1980, 192: 315, 8 pages.
Namwong et al., "Fabricating Simple Wax Screen-Printing Paper-Based Analytical Devices to Demonstrate the Concept of Limiting Reagent in Acid-Base Reactions," Journal of Chemical Education 95:2, 2018, 5 page.
Negin et al., "Application of nanotechnology for enhancing oil recovery—A review," Ke Ai Advanced Research Evolving Science, Petroleum 2: 324-333, 2016, 10 pages.
Negin et al., "Most common surfactants employed in chemical enhanced oil recovery," Petroleum 3: 197-211, 2017, 32 pages.
Ng et al., "Graphene-based two-dimensional Janus materials," NPG Asia Materials 10:4 (217-237), Apr. 2018, 21 pages.

(56) References Cited

OTHER PUBLICATIONS

Nge et al., "Advances in Microfluidic Materials, Functions, Integration, and Applications," Chem. Rev., Apr. 2013, 113, 2550-258, 34 pages.
Nguyen etl., "Separation and analysis of microplastics and nanoplastics in complex environmental samples" Acc Chem Res 52(4), Mar. 2019, 858-866, 23 pages.
Nie et al., "Probing Single Molecules and Single Nanoparticles by Surface-Enhanced Raman Scattering," Science 275:5303 (1102-1106), Feb. 21, 1997, 6 pages.
Nikonov et al., "Development of Remote Gas Condensate Fields: Challenges and Solutions," SPE 176660-MS, Society of Petroleum Engineers (SPE), SPE Russian Petroleum Technology Conference, Oct. 26-28, 2015, published Jan. 1, 2015, 21 pages.
Nödler et al., "Polar organic micropollutants in the coastal environment of different marine systems." Marine Pollution Bulletin 85.1, Aug. 2014, 50-59, 10 pages.
Ogden et al., "Complexation of Am(III) and Nd(in) by 1,10-Phenanthroli ne-2,9-Di carboxylic Acid," Journal of Solution Chemistry 42:1 (211-225), 2013, 15 pages.
Ouali et al., "Analysis of Paramagnetic NMR Spectra of Triple-Helical Lanthanide Complexes with 2,6-Dipicolinic Acid Revisited: a New Assignment of Structural Changes and Crystal-Field Effects 25 Years Later," Inorganic Chemistry 41:6 (1436-1445), Feb. 2002, 10 pages.
Ow et al., "First Deployment of a Novel Advanced Tracers System for Improved Waterflood Recovery Optimization." Paper presented at the Abu Dhabi International Petroleum Exhibition & Conference, Abu Dhabi, UAE, Nov. 2018, 10 pages.
Pallenberg et al. "Synthesis and Characterization of Some Copper(I) Phenanthroline Complexes," Inorg. Chem. 34: 2833-2840, 1995, 8 pages.
Park et al., "Application of montmorillonite in bentonite as a pharmaceutical excipient in drug delivery systems" Journal of Pharmaceutical Investigation, 46, May 2016, 363-375, 13 pages.
Parker and Williams, "Getting excited about lanthanide complexation chemistry," Journal of the Chemical Society, Dalton Transactions, 18: 3613-3628, 1996, 16 pages.
Parker et al., "Being excited by lanthanide coordination complexes: aqua species, chirality, excited-state chemistry, and exchange dynamics," Chemical Reviews, 102:6 (1977-2010), May 2002, 34 pages.
Peng et al., "A review of nanomaterials for nanofluid enhanced oil and recovery," The Royal Society of Chemistry, RSC Advances 7: 32246-32254, Jun. 13, 2017, 9 pages.
Peng, et al., "Micro- and nano-plastics in marine environment: Source, distribution and threats—a review" Sci. Total Environ, 698, 134254, 2020, 12 pages.
Petoud et al., "Brilliant SM, Eu, Tb, and Dy Chiral Lanthanide Complexes with Strong Circularly Polarized Luminescence," JACS Communications, Journal of the American Chemical Society 2017:129 (77-83), Dec. 15, 2006, 7 pages.
Pollock and Hammiche, "Micro-thermal analysis: techniques and applications," Journal of Physics D: Applied Physics, vol. 34.9, 2001, 31 pages.
Potapov et al., "Nanometer-Scale Distance Measurements in Proteins Using Gd3+ Spin Labeling," Journal of the American Chemical Society, 132(26): 9040-9048, Jun. 2010, 9 pages.
Qianming et al., "Bspda Synthesis and its Europium (III) Complexes' Fluorescence," Chemical Industry Times, Jul. 2005, 19(7): 38-41, 4 pages (English Abstract).
Quadri et al., "Screening of Polymers for EOR in High Temperature, High Salinity and Carbonate Reservoir Conditions," IPTC-18436-MS, presented at the International Petroleum Technology Conference (IPTC), Dec. 6-9, 2015, 30 pages.
Rashadan et al., "Effect of the preparation route, PEG and annealing on the phase stability of Fe3O4 nanoparticles and their magnetic properties," Journal of Experimental Nanoscience 8(2): 210-222, 2013, 14 pages.
Reese et al., "Synthesis of Highly Charged, Monodisperse Polystyrene Colloidal Particles for the Fabrication of Photonic Crystals," Colloid and Interface Science, 2000, 232: 76-80, 5 pages.
Reisch and Klymchenko, "Fluorescent Polymer Nanoparticles Based on Dyes: Seeking Brighter Tools for Bioimaging." Small 12(15): 1968-1992 2016, 25 pages.
Renault et al., "Three-Dimensional Wax Patterning of Paper Fluidic Devices," Langmuir, 30:23, 2014, 7 pages.
Ritter et al., "Octanol/Water Partition Coefficients for Environmentally Important Organic Compounds," Environ. Sci & Pollut. Res. 1995, 2, 153-160, 8 pages.
Rovani, "Enhanced Oil Recovery: Aqueous Flow Tracer Measurement" WRI-09-R002, OSTI.Gov, Technical Report, U.S. Department of Energy, Feb. 2009, 1-18, 25 pages.
Rowan et al., "Dynamic Covalent Chemistry," Angewante Chemie International Edition 41: 898-952, Mar. 15, 2002, 55 pages.
Rubasinghege et al., "Abiotic degradation and environmental toxicity of ibuprofen: Roles of mineral particles and solar radiation." Water research 131, Mar. 2018, 22-32, 11 pages.
Sabbatini et al., "Luminescent lanthanide complexes as photochemical supramolecular devices," Coordination Chemistry Reviews, 123:1-2 (201-228), Feb. 1993, 28 pages.
Sabhapondit et al., "Water Soluble Acrylamidomethyl Propane Sulfonate (AMPS) Copolymer as an Enhanced Oil Recovery Chemical," Energy & Fuels, 17:683-688, 2003, 6 pages.
Saeki et al., "Upper and lower critical solution temperatures in poly (ethylene glycol) solutions," Polymer, 17(8): 685-689, Aug. 1976, 5 pages.
Sajjadi, "Nanoparticles Formation by Monomer-Starved Semibatch Emulsion Polymerization," Langmuir, 23: 1018-1024, 2007, 7 pages.
Sajjadi, "Particle Formation under Monomer-Starved Conditions in the Semibatch Emulsion Polymerization of Styrene. I. Experimental.," Journal of Polymer Science: Part A: Polymer Chemistry, 39: 3940-3952, 2001, 13 pages.
Sammes and Yshioglu, "Modern bioassays using metal chelates as luminescent probes," Natural Product Reports, 31:1, 1996, 28 pages.
Sanni et al., "A field case study of inter-well chemical tracer test," SPE-173760-MS, Society of Petroleum Engineers (SPE), in SPE International Symposium on Oilfield Chemistry, Apr. 2015, 17 pages.
Sanni et al., "Pushing the envelope of residual oil measurement: a field case study of a new class of inter-well chemical tracers," Journal of Petroleum Science and Engineering 163, 2018, 19 pages.
Santarelli et al., "Formation Evaluation From Logging on Cuttings," SPE 36851, Society of Petroleum Engineers (SPE), presented at the 1996 SPE Permian Basin Oil and Gas Recovery Conference, Mar. 27-29, 1996, SPE Reservoir Evaluation and Engineering, published Jun. 1998, 7 pages.
Schmidt et al., "Copper dipicolinates as peptidomimetic ligands for the Src SH2 domain," Bioorganic & Medicinal Chemistry Letters, 14(16), 4203-4206, Aug. 2004, 4 pages.
Schmidt et al., "Synthesis of Mono- and Dinuclear Vanadium Complexes and Their Reactivity toward Dehydroperoxidation of Alkyl Hydroperoxides," Inorganic Chemistry 56(3): 1319-1332, 2017, 14 pages.
Seah et al., "Optimizing Recovery in Gas Condensate Reservoirs," SPE 171519-MS, Society of Petroleum Engineers (SPE), SPE Asia Pacific Oil and Gas Conference and Exhibition, Oct. 16, 2014, 19 pages.
Selvin et al., "Principles and biophysical applications of lanthanide-based probes," Annual Review of Biophysics and Biomolecular Structure 31: 275-302, Jun. 2002, 28 pages.
Serres-Piole et al., "Direct sensitive simultaneous determination of fluorinated benzoic acids in oil reservoir waters by ultra high-performance liquid chromatography-tandem mass spectrometry" Journal of Chromatography A, 1218, Aug. 2011, 6 pages.
Serres-Piole et al., "Water tracers in oilfield applications: Guidelines," Elsevier Ltd., Journal of Science and Engineering 98-99: 22-39, Nov. 2012, 18 pages.
ShamsiJazeyi et al., "Polymer-Coated Nanoparticles for Enhance Oil Recovery," Journal of Applied Polymer Science, 131:15, Aug. 5, 2014, 13 pages.

(56) References Cited

OTHER PUBLICATIONS

Sharma and Mohanty, "Wettability Alteration in High-temperature and High-salinity Carbonate Reservoirs," SPE 147306, Society of Petroleum Engineers (SPE), presented at the SPE Annual Technical Conference and Exhibition, Oct. 30-Nov. 2, 2011, SPE Journal 18:4 (646-655), Aug. 2013, 10 pages.
Shook et al., "Determining Reservoir Properties and Flood Performance from Tracer Test Analysis," SPE 124614, Society of Petroleum Engineers (SPE), presented at SPE Annual Technical Conference and Exhibition, Oct. 4-7, 2009, 19 pages.
sigmaaldrich.com [online] "pk20 Envicarb/LC-NH2/Si SPE Tubes 20m," Millapore Sigma, available on or before 2021, retrieved on Nov. 17, 2021, retrieved from URL <https://www.sigmaaldrich.com/US/en/product/supelco/54036u?context=product>, 4 pages.
sigmaaldrich.com [online] "Supelclean™ ENVI-Carb/NH2 SPE Tube," Millipore Sigma, available on or before 2021, retrieved on Nov. 17, 2021, retrieved from URL <https://www.sigmaaldrich.com/US/en/substance/supelcleanenvicarbnh2spetube1234598765?context=product>, 2 pages.
sigmaaldrich.com [online] "Supelclean™ SPE Method Development Kit," Millipore Sigma, available on or before 2021, retrieved on Nov. 17, 2021, retrieved from URL <https://www.sigmaaldrich.com/US/en/product/supelco/57074u?context=product>, 4 pages.
Silva et al., "Studies on new chemical tracers for determination of residual oil saturation in the inter-well region." SPE-185085-MS, SPE Oklahoma City Oil and Gas Symposium. OnePetro, Mar. 2017, 14 pages.
Silva et al., "Variation of the partition coefficient of phase-partitioning compounds between hydrocarbon and aqueous phases: an experimental study," Fuel, 300(120915), 2021, 15 pages.
Singh et al., "Paper-based sensors: emerging themes and applications," Sensors, 18:9, 2018, 22 pages.
Sobeih et al., "Recent trends and developments in pyrolysis-gas chromatography," Journal of Chromatography A, 1186:1-2 (51-66), Oct. 11, 2007, 16 pages.
Solomon et al., "Synthesis and Study of Silver Nanoparticles," Journal of Chemical Education 84(2): 332-325, 2007, 4 pages.
Song et al., "SERS-Encoded Nanogapped Plasmonic Nanoparticles: Growth of Metallic Nanoshell by Templating Redox-Active Polymer Brushes," JACS Communications, Journal of the American Chemical Society 136: 6838-6841, Apr. 28, 2014, 4 pages.
Speltini et al., "Newest applications of molecularly imprinted polymers for extraction of contaminants from environmental and food matrices: a review." Analytica Chimica Acta 974, Jun. 2017, 26 pages.
Sriram et al., "Paper-based microfluidic analytical devices for coloimetric detection of toxic ions," Trends in Analytical Chemistry, 93, Jun. 2017, 43 pages.
Stein et al., "Design and functionality of colloidal-crystal-templated materials-chemical applications of inverse opals," Chem. Soc. Rev., 2013, 42: 2763-2803, 41 pages.
Stephan et al., "Continuous-flow microfluidic method for octanol-water partitioncoefficient measurementKhaled," [Fluid Phase Equilibria 380: 116, 2014, 5 pages.
Stiles et al., "Surface-Enhanced Raman Spectroscopy," Annual Review of Analytical Chemistry 1: 601-626, Mar. 18, 2008, 29 pages.
Stryer et al., "Diffusion-enhanced fluorescence energy transfer," Annual Review of Biophysics and bioengineering 11:1, 1982, 21 pages.
Su et al., "A Dipicolinic Acid Tag for Rigid Lanthanide Tagging of Proteins and Paramagnetic NMR Spectroscopy," Journal of the American Chemical Society, 130:32 (10486-10487), Jul. 2008, 2 pages.
Sui, et al, "Occurrence, sources and fate of pharmaceuticals and personal care products in the groundwater: a review" Emerging Contaminants, vol. 1, Issue 1, Nov. 2015, 14-24, 11 pages.
Sýkora et al., "Recent advances in mixed-mode chromatographic stationary phases." Journal of separation science 42.1, Jan. 2019, 89-129, 75 pages.
Tabatabaei et al., "Well performance diagnosis with temperature profile measurements," in SPE Annual Technical Conference and Exhibition, Society of Petroleum Engineers, Oct. 30-Nov. 2, 2011, published Jan. 2011, 16 pages.
Takenaka et al., "Effect of fatty acids on the membrane fluidity of cultured chick dorsal root ganglion measured by fluorescence photobleaching recovery." Journal of neurobiology 14.6, Nov. 1983, 457-461, 5 pages.
Tang et al., "Synthesis and fluorescence properties of Tb(III) complexes with pyridine-2,6-dicarboxylic acid derivatives," Journal of Central South University of Technology (English Edition) 15:5 (599-605), Oct. 2008, 7 pages.
Tang et al., "Synthesis of Novel Derivatives of Pyridine-2,6-dicarboxylic Acid," Synthetic Communications: an International Journal for Rapid Communication of Synthetic Organic Chemistry 36:14 (2027-2034), Jun. 2006, 9 pages.
Tang et al., "Synthesis of Eu(III) and Tb(III) Complexes with Novel Pyridine-2,6-Dicarboxylic Acid Derivatives and Their Fluorescence Properties," Front. Chem. China 4: 408-413, 2006, 6 pages.
Tathed et al., "Hydrocarbon saturation in Bakken Petroleum System based on joint inversion of resistivity and dielectric dispersion logs," Fuel, Dec. 2018, 233: 45-55, 11 pages.
Taylor et al., "Water-Soluble Hydrophobically Associating Polymers for Improved Oil Recovery: a Literature Review," SPE 29008, Society of Petroleum Engineers (SPE), Journal of Petroleum Science and Engineering, 19:3-4 (265-280), Mar. 1998, 16 pages.
Teledyne Princeton Instruments, "PI-MAX 4: 1024 EMB," Datasheet, available on or before May 13, 2020, retrieved from URL <https://www.princetoninstruments.com/products/pi-max-family>, 8 pages.
Thomas et al., "Deployment and Detection of a Novel Barcoded Advanced Tracers System for the Optimization of Improved Waterflood Recovery in Hydrocarbon Reservoirs" SPE-194872-MS, SPE Middle East Oil and Gas Show and Conference. Society of Petroleum Engineers, 2019, 10 pages.
Tian et al., "Off-Resonant Gold Superstructures as Ultrabright Minimally Invasive Surface-Enhanced Raman Scattering (SERS) Probes," American Chemical Society (ACS Publications), Chemistry of Materials (CM) 27: 5678-5684, Jul. 2015, 7 pages.
Toulhoat, "Experimentation and Modelling of U, Th and Lanthanides Transport in Fissured Rocks: Influence of Complexation," MRS Proceedings 50, Jan. 1, 1985, 8 pages.
Trippetta et al., "The seismic signature of heavy oil on carbonate reservoir through laboratory experiments and AVA modelling," Journal of Petroleum Science and Engineering, 2019, 177: 849-860, 12 pages.
Vaccaro et al., "Flow Approaches Towards Sustainability," Green Chem, 16:3680-3704, 2014, 25 pages.
Vatanparast et al., "Wettability alteration of low-permeable carbonate reservoir rocks in presence of mixed ionic surfactants," Petroleum Science and Technology 29:18 (1873-1884), 2011, 14 pages.
Vermolen et al., "Pushing the Envelope for Polymer Flooding Towards High-temperature and High-salinity Reservoirs with Polyacrylamide Based Terpolymers," SPE 141497, Society of Petroleum Engineers (SPE), presented at SPE Middle East Oil and Gas Show and Conference, Mar. 20-23, 2011, 9 pages.
Vollrath et al., "Fluorescence imaging of cancer tissue based on metal-free polymeric nanoparticles—a review." J. Mater. Chem. B 1:15 (1994-2007), 2013, 15 pages.
Wagner, "The Use of Tracers in Diagnosing Interwell Reservoir Heterogeneities—Field Results," SPE-6046, Society of Petroleum Engineers (SPE), Journal of Petroleum Technology, Nov. 1997, 7 pages.
Wahajuddin et al., "Superparamagnetic iron oxide nanoparticles: Magnetic nanoplatforms as drug carriers" International Journal of Nanomedicine, 7, Jul. 2012, 3445-3471, 27 pages.
Walther et al., "Janus Particles: Synthesis, Self-Assembly, Physical Properties and Applications," American Chemical Society (ACS Publications), Chem. Rev. 113:7 (5194-5261), Apr. 2013, 68 pages.
Wampler, "Chapter 1: Applied pyrolysis: an overview," Applied Pyrolysis Handbook, 2007, 26 pages.
Wang et al., "Fabrication of Near Infrared Photonic Crystals using Highly-Monodispersed Submicrometer SiO2 Spheres," J. Phys. Chem. B 2003, 107 (44), 12113-12117.

(56) References Cited

OTHER PUBLICATIONS

Wang et al., "Fabrication of Two- and Three-Dimensional Silica Nanocolloidal Particle Arrays," J. Phys. Chem. B, 2003, 107(15): 3400-3404, 5 pages.
Wang et al., "Self-assembly of two and three-dimensional particle arrays by manipulating the hydrophobicity of silica nanospheres," Journal of Physical Chemistry, Nov. 2005, 109(47): 22175-22180, 6 pages.
Wang et al., "The Design and Implementation of a Full Field Inter-Well Tracer Program on a Giant UAE Carbonate Oil Field," SPE-177527-MS, Society of Petroleum Engineers (SPE), in Abu Dhabi International Petroleum Exhibition and Conference, Nov. 2015, 8 pages.
Wang et al., "Toward Reservoir on a Chip: Fabricating Reservoir Micromodels by in Situ Growing Calcium Carbonate Nanocrystals in Microfluidic Channels," ACS Applied Materials and Interfaces, 2017, 21 pages.
Wever et al., "Polymers for enhanced oil recovery: a paradigm for structure-property relationship in aqueous solution," Progress in Polymer Science, 36:11 (1558-1628), Nov. 2011, 71 pages.
Wu et al., "Development of New Polymers with Better Performance under Conditions of High Temperature and High Salinity," SPE 155653, Society of Petroleum Engineers (SPE), presented at the SPE EOR Conference at Oil and Gas, Apr. 16-18, 2012, 11 pages.
Wu et al., "A reusable biosensor chip for SERS-fluorescence dual mode immunoassay," Proc. SPIE 9543: 954317-1, presented at the Third International Symposium on Laser Interaction with Matter (LIMIS), May 4, 2015, 6 pages.
Wu et al., "A SERS-Assisted 3D Barcode Chip for High-Throughput Biosensing," Material Views Full Papers, Small Journal 11:23 (2798-2806), Jun. 11, 2015, 9 pages.
Xu et al., "Superparamagnetic Photonic Crystals" Adv. Mater., Nov. 2001, 13, 1681-1683, 4 pages.
Xu et al., "Synthesis and Utilization of Monodisperse Superparamagnetic Colloidal Particles for Magnetically Controllable Photonic Crystals" Chem. Mater., 14(3), 2002, 1249-1256, 8 pages.
Xu et al., "Measurement of two-photon excitation cross sections of molecular fluorophores with data from 690 to 1050 nm," Journal of the Optical Society of America B 13:3, Mar. 1996, 11 pages.
Yang et al., "Nanoscale geochemical and geomechanical characterization of organic matter in shale," Nature Communications, vol. 8, 2179, Dec. 19, 2017, 9 pages.
Yang et al., "The Co-Luminescence Groups of Sm—La-pyridyl Carboxylic Acids and the Binding Characteristics between the Selected Doped Complex and Bovine Serum Albumin," Bulletin of the Korean Chemical Society 33:4 (1303-1309), Apr. 20, 2012, 7 pages.
Yang et al., "Paramagnetic labeling of proteins and pseudocontact shift in structural biology," Chinese Journal of Magnetic Resonance, 2014, 31:2 (155-171), English Abstract.
Ye et al., "Synthesis and Characterization of a Water-Soluble Sulfonates Copolymer of Acrylamide and N-Allylbenzamide as Enhanced Oil Recovery Chemical," Journal of Applied Polymer Science, 128:3, (2003-2011), May 5, 2013, 9 pages.
Yu et al., "Adsorption of proteins and nucleic acids on clay minerals and their interactions: a review" Applied Clay Science, 80-81, Aug. 2013, 443-452, 10 pages.
Yu et al., "New insights into flow physics in the EOR process based on 2.5D reservoir micromodels," Journal of Petroleum Science and Engineering, Jun. 2019, 181, XP085751272, 13 pages.
Yun et al., "Toward Reservoir on a Chip: Rapid Performance Evaluation of Enhanced Oil Recovery Surfactants for Carbonate Reservoirs Using a Calcite-Coated Micromodel," Nature Scientific Reports, 2020, 12 pages.
Zamberi et al., "Improved Reservoir Surveillance Through Injected Tracers in a Saudi Arabian Field: Case Study," SPE 166005, Society of Petroleum Engineers (SPE), presented at the SPE Reservoir Characterization and Simulation Conference and Exhibition, Sep. 16-18, 2013, 15 pages.
Zemel, "Chapter 3: Tracers in the Oil Field," in Tracers in the Oil Field, Technology and Engineering, Elsevier 43, Jan. 1995, 47 pages.
Zhang and Liu, "Mixed-mode chromatography in pharmaceutical and biopharmaceutical applications," Journal of Pharmaceutical and Biomedical Analysis, 2016, 128: 73-88, 16 pages.
Zhang et al., "Effect of Concentration on HPAM Retention in Porous Media," SPE-166265-PA, Society of Petroleum Engineers (SPE), presented as SPE Annual Technical Conference and Exhibition, 373-380, Sep. 30-Oct. 2, 2013, 11 pages.
Zhang et al., "Janus Particles: Synthesis, Self-Assembly, Physical Properties, and Applications," American Chemical Society (ACS Publications), Langmuir 33: 6964-6977, 2017, 14 pages.
Zhang et al., "Novel zwitterionic surfactant derived from castor oil and its performance evaluation for oil recovery," Colloids Surfaces A: Physicochemical and Engineering Aspects 483: 87-95, 2015, 42 pages.
Zhang et al., "Water adsorption on kaolinite and illite after polyamine adsorption" Journal of Petroleum Science and Engineering, 142, Jun. 2016, 13-20, 8 pages.
Zhang et al., "Geomaterial-Functionalized Microfluidic Devices Using a Universal Surface Modification Approach," Advanced Material Interfaces, 2019, 6:23, 16 pages.
Zhao et al., "Chromatographic Separation of Highly Soluble Diamond Nanoparticles Prepared by Polyglycerol Grafting," Angewandte Chemie International Edition, 50:6 (1388-1392), Feb. 7, 2011, 5 pages.
Zheng et al., "Immobilization of Candida rugosa lipase on hydrophobic/strong cation-exchange functional silica particles for biocatalytic synthesis of phytosterol esters." Bioresource technology 115, Jul. 2012, 141-146, 6 pages.
Zhou et al., "Upconversion luminescent materials: advances and applications," American Chemical Society (ACS Publications), Chemical Reviews, 115: 395-465, Jan. 14, 2015, 71 pages.
Chen et al., "Optimization of Tracer Injection Schemes for Improved History Matching," SPE-206142-MS, OnePetro, Sep. 2021, 9 pages.
U.S. Appl. No. 17/548,837, Wang, Manipulating Hydrophilicity of Conventional Dye Molecules for Water Tracer Applications, filed Dec. 13, 2021, 48 pages.
U.S. Appl. No. 17/548,858, Wang, Method of Manipulating Hydrophilicity and Hydrophobicity of Conventional Dye Molecules for Tracer Applications, filed Dec. 13, 2021, 54 pages.
U.S. Appl. No. 17/549,062, Wang, Method and Materials for Extraction of Oil-Soluble Organic Molecular Tracers From Oil Phases, filed Dec. 13, 2021, 67 pages.
U.S. Appl. No. 17/643,931, Wang, Manipulating Hydrophilicity and Hydrophobicity of Conventional Dye Molecules for Tracer Applications, dated Dec. 13, 2021, 46 pages.
PCT International Search Report and Written Opinion in Appln. No. PCT/US2022/053001, dated Jun. 7, 2023, 18 pages.
PCT Invitation to Pay Additional Fees and, Where Applicable, Protest Fee in Appln. No. PCT/US2022/053001, dated Apr. 13, 2023, 10 pages.

* cited by examiner

DETERMINING OIL AND WATER PRODUCTION RATES IN MULTIPLE PRODUCTION ZONES FROM A SINGLE PRODUCTION WELL

TECHNICAL FIELD

This disclosure relates to production fluid analysis during hydrocarbon production.

BACKGROUND

During hydrocarbon production, a single wellbore can produce from multiple production zones by passing through multiple, stacked production zones, branching out into side-track wellbores, or through other arrangements. In some implementations, production fluid from various production zones are directed through the wellbore by separate production tubing. In some implementations, the production fluid from various production zones are comingled and directed through a single production tubing string. Once at a topside facility, the production fluid is separated into its various components: oil, water, and gas.

SUMMARY

This disclosure describes technologies relating to determining water-cuts in multiple production zones from a single production well.

An example implementation of the subject matter described within this disclosure is a method with the following features. A wellbore that supplies production fluid from a first production zone and a second production zone is produced. Production fluids from the first and second production zone are comingled within a same production tubular. A first tracer is pulsed into the first production zone. A second tracer is pulsed into the second production zone. The first tracer and the second tracer are barcoded such that the first tracer and the second tracer can be differentiated from one another. A first tracer decay is measured at a topside facility. A second tracer decay is measured at the topside facility. A water cut of the first production zone and the second production zone is determined based upon the first tracer decay and the second tracer decay.

Aspects of the example method, which can be used alone with the example method or in conjunction with other aspects of the example method, include the following. A first subsurface control valve is actuated to regulate the production fluids from the first production zone. Alternatively or in addition, a second subsurface control valve is actuated to regulate the production fluids from the second production zone.

Aspects of the example method, which can be used alone with the example method or in conjunction with other aspects of the example method, include the following. Production remains continuous while pulsing the first tracer, while pulsing the second tracer, while measuring the decay of the first tracer, and while measuring the decay of the second tracer.

Aspects of the example method, which can be used alone with the example method or in conjunction with other aspects of the example method, include the following. Pulsing the first tracer includes ceasing flow of the first tracer.

Aspects of the example method, which can be used alone with the example method or in conjunction with other aspects of the example method, include the following. Pulsing the second tracer includes a step-function pulse of a specified duration of time.

Aspects of the example method, which can be used alone with the example method or in conjunction with other aspects of the example method, include the following. Pulsing the first tracer and the second tracer include pulsing hydrophilic tracers.

Aspects of the example method, which can be used alone with the example method or in conjunction with other aspects of the example method, include the following. Determining the water cut of the first production zone or the second production zone includes using the following equation:

$$T_{oil(i)} = \sim\exp(-aQ_i t)$$

wherein $T_{oil(i)}$ is the tracer concentration in oil from a specified production zone, a is a geometrical constant of an annular completion region, approximately equal to 1/V, where Vis the volume of the annular region from the mouth of the dosing line up to the mouth of the inflow control valve, $Q_i$ is a total oil production flow rate from the specified production zone, and tis time.

Aspects of the example method, which can be used alone with the example method or in conjunction with other aspects of the example method, include the following. A third tracer is pulsed into the first production zone. A fourth tracer is pulsed into the second production zone.

Aspects of the example method, which can be used alone with the example method or in conjunction with other aspects of the example method, include the following. Measuring a first tracer decay and a second tracer decay includes taking production samples at the topside facility at specified intervals. The samples are tested to determine tracer concentrations at the specified time intervals. A decay slope of each tracer in each zone is determined based upon the tested samples.

An example implementation of the subject matter described within this disclosure is a system with the following features. A production well includes a first production zone and a second production zone. Production tubing is arranged to receive production fluid from the first production zone and the second production zone. A first subsurface control valve regulates flow from the first production zone into the production tubing. A second subsurface control valve regulates flow from the second production zone into the production tubing. A first actuatable injection tube has a first outlet adjacent to a first inlet of the production tubing within the first production zone. A second actuatable injection tube has a second outlet adjacent to a second inlet of the production tubing within the first production zone.

Aspects of the example system, which can be used alone with the example system or in conjunction with other aspects of the example system, include the following. A third injection tube has a third outlet adjacent to the first inlet of the production tubing within the first production zone. A fourth injection tube has a fourth outlet adjacent to the second inlet of the production tubing within the second production zone.

Aspects of the example system, which can be used alone with the example system or in conjunction with other aspects of the example system, include the following. A real-time sensor is at a topside facility. A controller is configured to send a control signal to a first topside pressure pump. The control signal is configured to cause the pump to pulse a first tracer into the first production zone. The controller is configured to send a control signal to a second topside pressure pump. The control signal is configured to cause the pump to pulse a second tracer into the second production zone. The first tracer and the second tracer are barcoded such that the first tracer and the second tracer can be differentiated from one another. A first tracer decay is measured at a topside facility by the real-time sensor. A second tracer decay is measured at the topside facility by the real-time sensor. A water cut of the first production zone and the second production zone is determined by the controller based upon the first tracer decay and the second tracer decay. A control signal is sent, by the controller, to the first subsurface control valve. The signal is configured to actuate a first subsurface control valve to regulate the production fluids from the first production zone. A control signal is sent, by the controller, to the second subsurface control valve. The signal is configured to actuate a second subsurface control valve to regulate the production fluids from the second production zone.

An example implementation of the subject matter described within this disclosure is a method with the following features. A wellbore that supplies production fluid from a first production zone and a second production zone produces production fluids from the first and second production zone. The production fluids from each zone are comingled within a same production tubular. A first tracer is pulsed into the first production zone. A second tracer is pulsed into the second production zone. The first tracer and the second tracer are barcoded such that the first tracer and the second tracer can be differentiated from one another. A first tracer decay is measured at a topside facility. A second tracer decay is measured at the topside facility. A water cut of the first production zone and the second production zone is determined based upon the first tracer decay and the second tracer decay. a first subsurface control valve is actuated, responsive to determining the water cut of the first production zone and the second production zone, to regulate the production fluids from the first production zone. A second subsurface control valve is actuated, responsive to determining the water cut of the first production zone and the second production zone, to regulate the production fluids from the second production zone.

Aspects of the example method, which can be used alone with the example method or in conjunction with other aspects of the example method, include the following. Pulsing the second tracer includes ceasing flow of the first tracer.

Aspects of the example method, which can be used alone with the example method or in conjunction with other aspects of the example method, include the following. Pulsing the first tracer comprises a step-function pulse of a specified duration of time.

Aspects of the example method, which can be used alone with the example method or in conjunction with other aspects of the example method, include the following. Determining the water cut of the first production zone and the second production zone includes using the following equation:

$$T_{water(i)}=T_o \exp(-aQ_i t)/(Q_1+Q_2)$$

where $T_{ater(i)}$ is hydrophilic tracer concentration in water from a specified production zone, $T_o$ is a tracer concentration injected down the dosing line from the surface, a is a geometrical constant of an annular production zone, a being approximately equal to 1/V, where V is an annular volume of the production zone from the mouth of the dosing line up to the mouth of the inflow control valve, $Q_i$ is a total production flow rate from the specified production zone, $Q_1$ is a total production flowrate from the first production zone, $Q_2$ is a total production rate from the second production zone, and t is time.

Aspects of the example method, which can be used alone with the example method or in conjunction with other aspects of the example method, include the following. A third tracer is pulsed into the first production zone. A fourth tracer is pulsed into the second production zone.

Aspects of the example method, which can be used alone with the example method or in conjunction with other aspects of the example method, include the following. Measuring a first tracer decay and a second tracer decay includes taking production samples at the topside facility at specified intervals. The samples are tested to determine tracer concentrations at the specified time intervals. A decay slope of each tracer in each zone is determined based upon the tested samples.

Aspects of the example method, which can be used alone with the example method or in conjunction with other aspects of the example method, include the following. Production remains continuous during pulsing and measuring.

Aspects of the example method, which can be used alone with the example method or in conjunction with other aspects of the example method, include the following. Pulsing the first tracer and the second tracer includes pulsing oleophilic tracers.

Particular implementations of the subject matter described in this disclosure can be implemented so as to realize one or more of the following advantages. Aspects of this disclosure allow for water-cut determinations to be made for multiple production zones being produced from a single well. Such determinations and analysis are performed without shutting in any of the production zones. Alternatively or in addition, the subject matter described herein has a lower-cost than installing downhole flow-meters in the various laterals. The subject matter described herein also involves low capital costs to install the dosing lines and may be implemented at any time thereafter in the life of the well, even decades later.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

This disclosure relates to determining oil production rates and water cuts within multi-zone, comingled wells. Tracers are injected into multiple zones, each zone of tracers is barcoded to identify the zone. The tracers include hydrophilic and oleophilic tracers. A transient is performed on the tracer injection. The transient creates a decay profile that can be detected at the topside facility. The profiles for each individual production zone can be used to determine a water cut for each zone. The various production zones can then be throttled to optimize hydrocarbon production.

Figure 1:
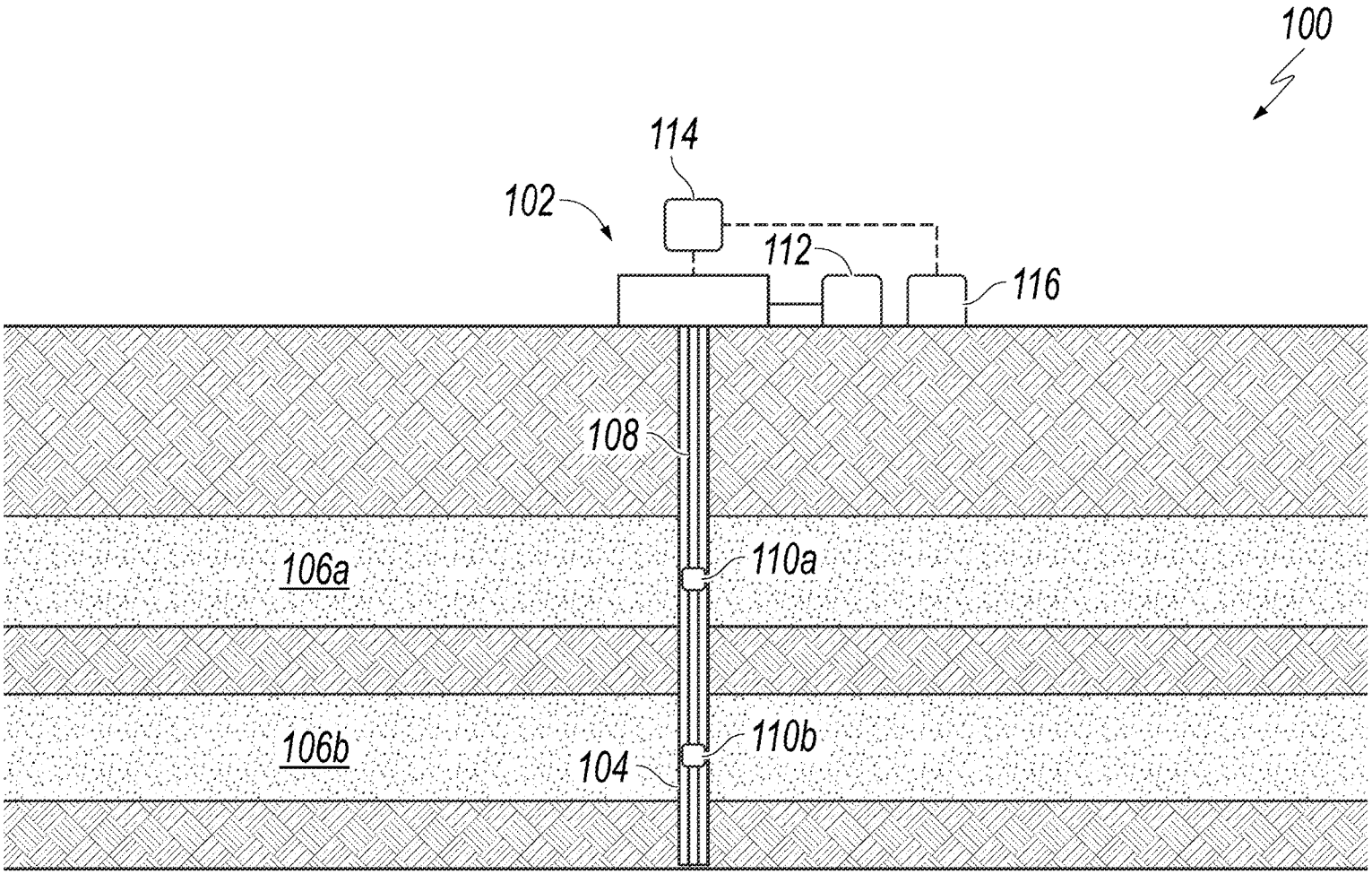
FIG. 1 is a schematic diagram of an example well production system.

FIG. 1 is a schematic diagram of an example well production system 100. The well production system 100 includes a topside facility 102 atop a production well 104 formed within a geologic formation. The production well 104 includes a first production zone 106*a* and a second production zone 106*b*. That is, the production well 104 passes through the first production zone 106*a* and the second production zone 106*b*. The production well 104 includes production tubing 108 passing through the production well 104. The production tubing is arranged to receive production fluid from the first production zone 106*a* and the second production zone 106*b*. The production tubing 108 is also configured to direct comingled production fluid streams from the first production zone 106*a* and the second production zone towards the topside facility 102. Coupled to the production tubing 108 is a first subsurface control valve 110*a* regulating flow from the first production zone 106*a* into the production tubing. Similarly, a second subsurface control valve 110*b* is coupled to the production tubing 108 and regulates flow from the second production zone 106*b* into the production tubing 108. The topside facility 102 also includes chemical injection pumps 112 that can be used to pump chemicals, such as tracers, into each production zone.

While primarily illustrated and described as a single production well 104 with two production zones (106*a*, 106*b*), any number of production wells and production zones can be used without departing from this disclosure. While illustrated as a vertical wellbore passing through two horizontal production zones, other well arrangements can be used without departing from this disclosure. For example, aspects of this disclosure are applicable to horizontal, deviated, or sidetrack production wells.

In some implementations, the topside facility 102 includes a real-time sensor 114 capable of analyzing production streams for tracers. The topside facility 102 includes a controller 116, for example, a control room. Details on an example controller and capabilities of the example controller are described throughout this disclosure. Other equipment, such as separator, pumps, and compressors, can be included within the topside facility 12 without departing from this disclosure.

Figure 2:
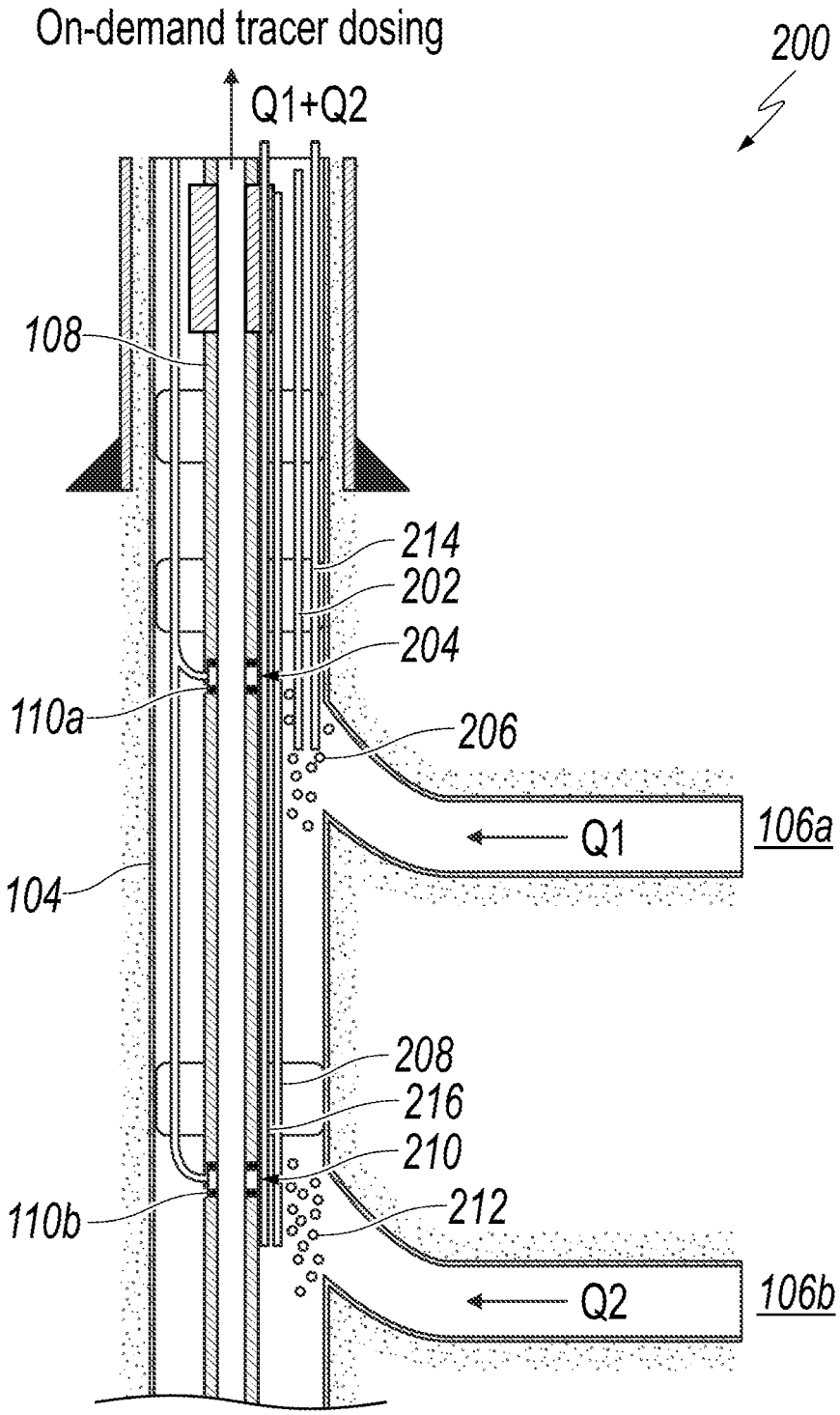
FIG. 2 is a side cross-sectional view of an example downhole production system.

FIG. 2 is a side cross-sectional view of an example downhole production system 200. As previously described, the first production zone 106*a* flows into the production tubing 108 through the first subsurface control valve 110*a*. Similarly, the second production zone 106*b* flows into the production tubular through the second subsurface control valve 110*b*. A first actuatable injection tube 202 has a first outlet adjacent to a first inlet 204 of the production tubing 108 within the first production zone 106*a*. The first injection tube 202 is configured to inject a first tracer 206 into the production fluid entering the production tubing from the first production zone 106*a*. Similarly, a second actuatable injection tube 208/has a second outlet adjacent to a second inlet 210 of the production tubing 108 within the second production zone 106*b*. The second injection tube 208 is configured to inject a second tracer 212 into the production fluid entering the production tubing from the first production zone 106*a*. The actuating aspect of each injection tube is performed by the topside chemical injection pumps 112 (FIG. 1). The first tracer 206 and the second tracer 212 have similar properties, for example, both tracers can be hydrophilic or oleophilic; however, the first tracer 206 and the second tracer 212 are barcoded such that they can be differentiated from one another. For example, the first tracer 206 can fluoresce responsive to a different wavelength of stimulating light than the second tracer 212. Luminescent or optically active tracers detectable can be differentiated (barcoded) by spectral characteristics such as wavelength of maximum emission, wavelength of maximum absorption, and/or luminescent lifetime. In some implementations, the tracers are trace metal ions that can be sensitively and unambiguously identified with spectroscopic methods such as x-ray fluorescence, inductively coupled plasma mass spectroscopy or inductively coupled plasma optical emission spectroscopy. In some implementations, the tracers include materials that can be degraded predictably under specific conditions and the degradation products can be detected by common spectroscopic methods after chromatographic separation. For example, polymers with a ceiling temperature, such as styrenic or methacrylate type polymers undergo depolymerizatoin when heated to the ceiling temperature. In such implementations, the monomer is a major degradation product. The monomer of specific mass can be readily detected by mass spectroscopy after gas chromatographic separation.

In some implementations, a third injection tube 214 with a third outlet adjacent to the first inlet 204 of the production tubing 108 within the first production zone 106*a* can be included. Similarly, in some implementations a fourth injection tube 216 with a fourth outlet adjacent to the second inlet 210 of the production tubing within the second production zone can be included. In such implementations, the third injector tube 214 and the fourth injector tube 216 are configured to inject other tracers different from the first tracer and the second tracer. For example, if the first injection tube 202 and the second injection tube 208 inject an oleophilic tracer, then the third injection tube 214 and the fourth injection tube 216 could inject a hydrophilic tracer. Tracers injected by the third injection tubing 214 and the fourth injection tubing can also be barcoded such that the tracers can be differentiated during analysis.

Figure 3:
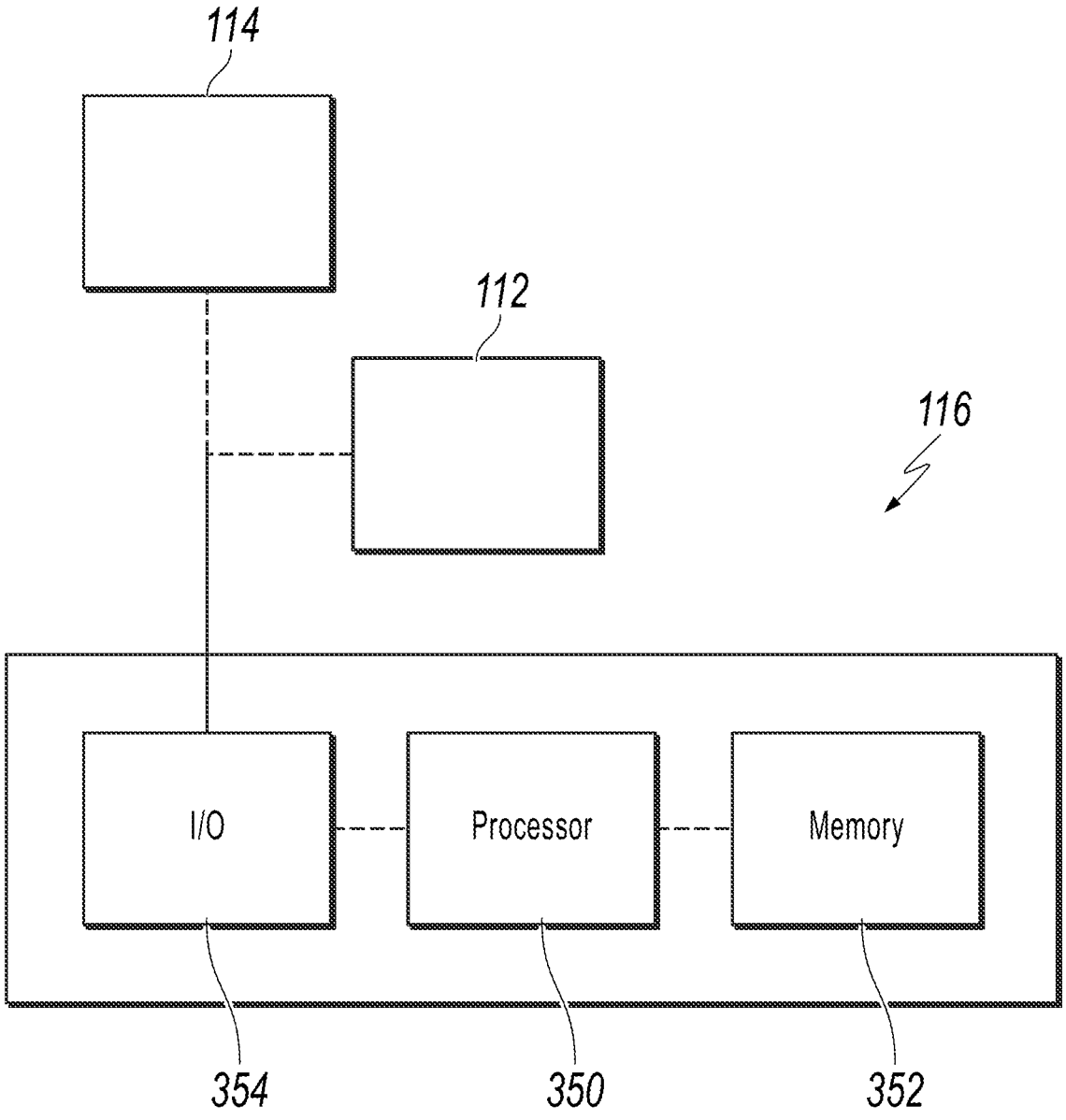
FIG. 3 is a block diagram of an example controller that can be used with aspects of this disclosure.

FIG. 3 is a schematic diagram of an example controller 116 that can be used with aspects of this disclosure. The controller 116 can, among other things, monitor parameters of the system 100 and send signals to actuate and/or adjust various operating parameters of the system 100. As shown in FIG. 3, the controller 116, in certain instances, includes a processor 350 (e.g., implemented as one processor or multiple processors) and a memory 352 (e.g., implemented as one memory or multiple memories) containing instructions that cause the processors 350 to perform operations described herein. The processors 350 are coupled to an input/output (I/O) interface 354 for sending and receiving communications with components in the system, including, for example, the real-time sensor 114. In certain instances, the controller 116 can additionally communicate status with and send actuation and/or control signals to one or more of the various system components (including an actuatable systems, such as the first subsurface control valve 110*a* or the second subsurface control valve 110*b*) of the system 100, as well as other sensors (e.g., pressure sensors, temperature sensors, and other types of sensors) provided in the system 100. In certain instances, the controller 116 can communicate status and send control signals to one or more of the components within the system 100, such as the chemical pumps 112. The communications can be hard-wired, wireless or a combination of wired and wireless. In some implementations, controllers similar to the controller 116 can be located elsewhere, such as in a control room, a data van, elsewhere on a site or even remote from the site. In some implementations, the controller 116 can be a distributed controller with different portions located about a site or off site. For example, in certain instances, the controller 116 can be located at the real-time sensor 114, or it can be located in a separate control room or data van. Additional controllers can be used throughout the site as stand-alone controllers or networked controllers without departing from this disclosure.

The controller 116 can operate in monitoring, commanding, and using the system 100 for measuring tracers in various production streams and determining water-cuts of each production zone in response. To make such determinations, the controller 116 is used in conjunction with the real-time sensor or a database in which a technician can input test result values. Input and output signals, including the data from the sensor, controlled and monitored by the controller 116, can be logged continuously by the controller 116 within the controller memory 352 or at another location.

The controller 116 can have varying levels of autonomy for controlling the system 100. For example, the controller 116 can initiate a tracer pulse, and an operator adjusts the subsurface control valves (110*a*, 110*b*). Alternatively, the controller 116 can initiate a tracer pulse, receive an additional input from an operator, and adjust the subsurface control valves (110*a*, 110*b*) with no other input from an operator. Alternatively, the controller 116 can a tracer pulse and actively adjust the subsurface control valves (110*a*, 110*b*) with no input from an operator.

Regardless of the autonomy of the controller operation, the controller can perform any of the following functions. The controller is configured to send a control signal to a first topside pressure pump, such as chemical pump 112. The control signal is configured to cause the pump to pulse a first tracer 206 into the first production zone 106*a*. The controller is configured to send a control signal to a second topside pressure pump. The control signal is configured to cause the pump to pulse a second tracer into the second production zone. As a reminder, the first tracer and the second tracer are barcoded such that the first tracer and the second tracer can be differentiated from one another. The controller 116 can also be configured to measure, or receive a signal indicative of a measurement from the real-time sensor, a first tracer decay, the second tracer decay, or both at a topside facility 102. Based on the first tracer decay and the second tracer decay, the controller is configured to determine a water cut of the first production zone 106*a* and the second production zone 106*b*. In some implementations, the controller is configured to send a control signal to the first subsurface control valve 110*a*, the second subsurface control valve 110*b*, or both. The signal is configured to actuate the first subsurface control valve 110*a*, the second subsurface control valve 110*b*, or both, to regulate the production fluids from the first production zone, the second production zone, or both.

Figure 4A:
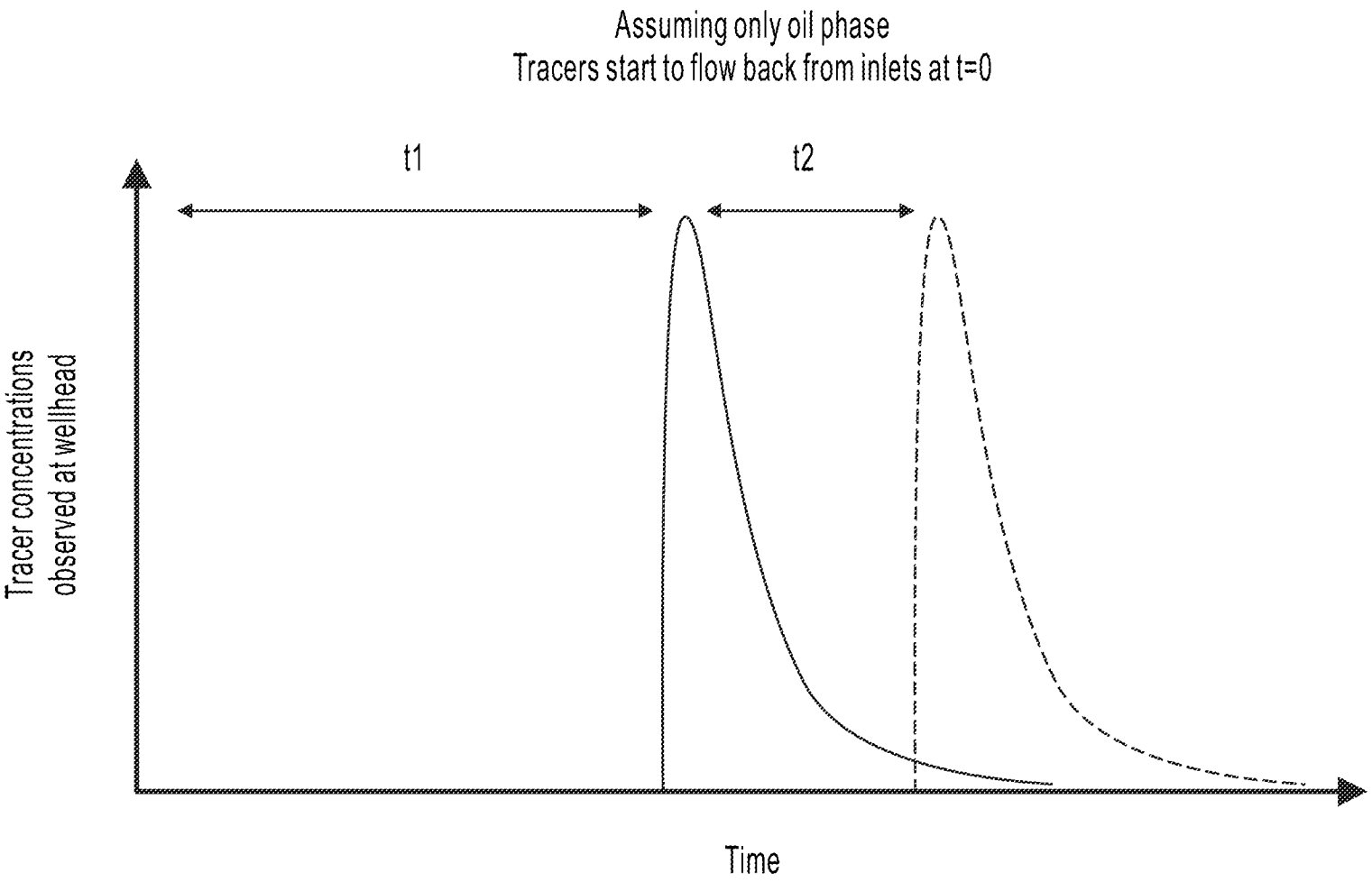
FIGS. 4A-4C are examples of tracer pulses that can be used with aspects of this disclosure.
Figure 4B:
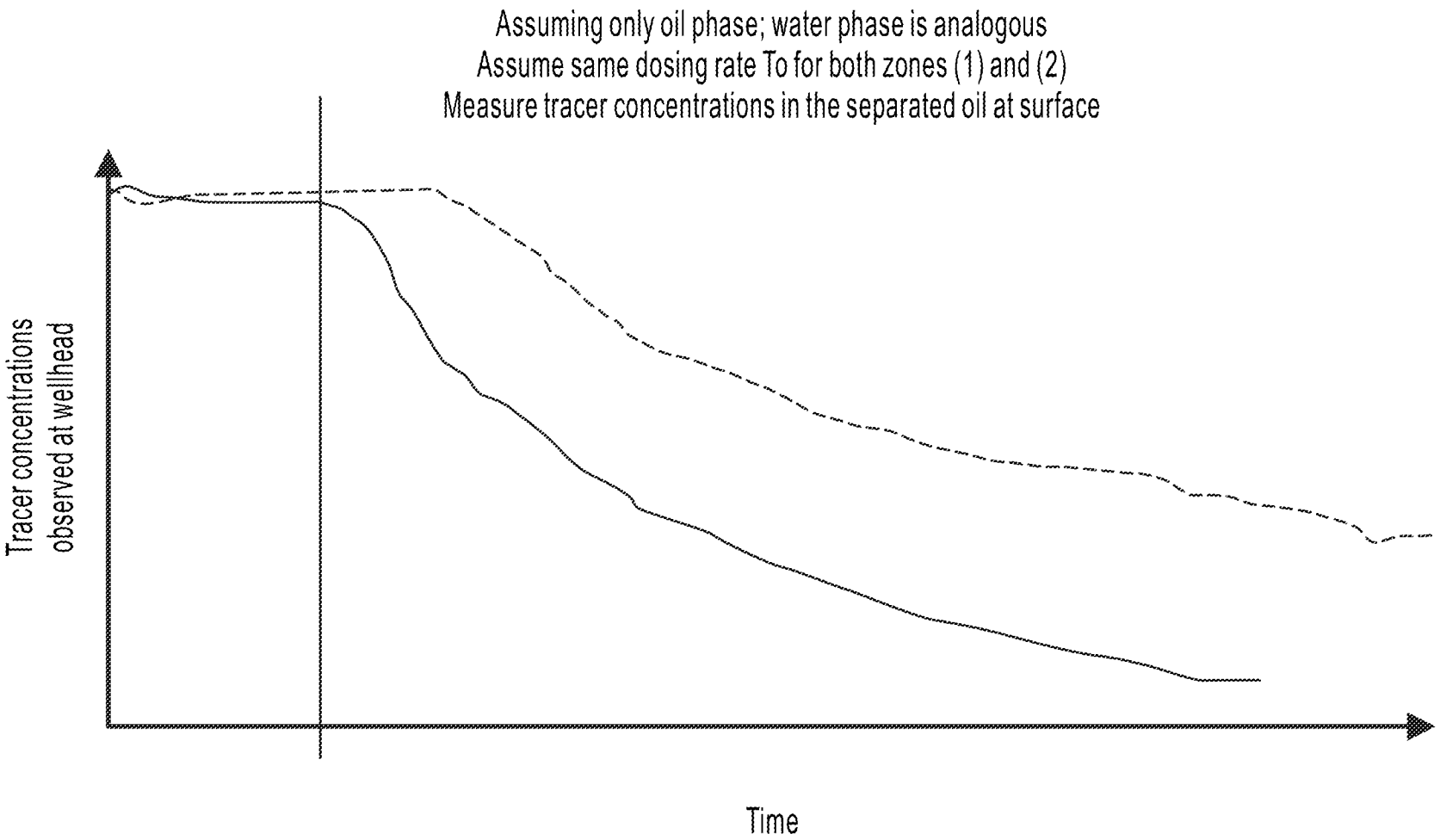
Figure 4C:
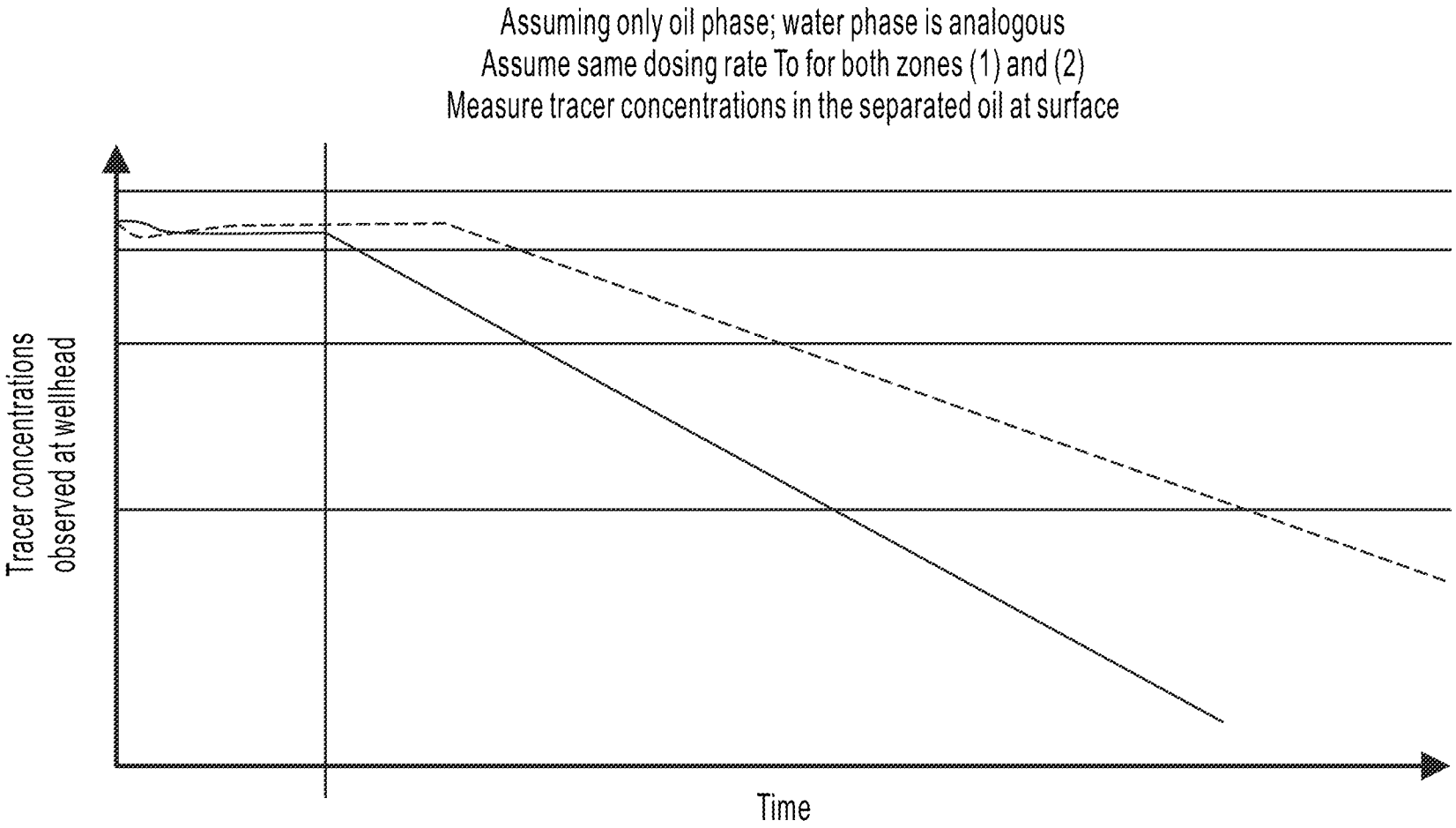

FIGS. 4A-4C are examples of tracer pulses that can be used with aspects of this disclosure. Tracer concentrations are measured in phase-separated wellhead fluid samples collected at appropriate times after downhole injection. While primarily described using oleophilic tracers, similar injections and measurements can be made with hydrophilic tracers on the water production rates without departing from this disclosure. FIG. 4A shows a pulse arrangement 502 where oleophilic tracers are injected into the first production zone and the second production zone as a step function pulse, for example, a pulse that approximates a square wave, saw-tooth wave, or similar pulse with a hard transient change. The time for the first tracer pulse to be detected at the topside facility 102 is determined by the following equation:

$$t_1 = L_1 \times A/(Q_1+Q_2) \tag{1}$$

where $t_1$ is the time for the first pulse to be detected, $L_1$ is the downhole length from the topside facility 102 to the inlet to the first subsurface control valve 110*a*, A is the cross sectional area of the production tubing 108, $Q_1$ is the oil flow rate from the first production zone 106*a*, and $Q_2$ is the oil flow rate from the second production zone 106*b*.

The time for the second tracer pulse to be detected at the topside facility 102 is determined by the following equation:

$$t_2 = L_2 \times A/Q_2 \tag{2}$$

where $t_2$ is the time for the second pulse to be detected after the first pulse is detected, $L_2$ is the downhole length within the completion from the first subsurface control valve 110*a* inlet to the second subsurface control valve 110*b* inlet. By measuring $t_1$ and $t_2$, the influx rates $Q_1$ and $Q_2$ can be determined by solving equations (1) and (2).

FIG. 4B illustrates a tracer injection pulse profile where pulsing the first tracer 206 and the second tracer 212 includes abruptly ceasing a flow of each tracer. That is, steadily flowing each tracer for a set amount of time, then abruptly ceasing flow of both tracers simultaneously such that a distinct transient occurs. The decay rate in this instance has an exponential decay that can be used to determine the total oil production in each zone using the following equations:

$$T_{oil\ 1} \sim \exp(-a\ Q_1 t) \tag{3}$$

$$T_{oil\ 2} \sim \exp(-a\ Q_2 t) \tag{4}$$

Where $T_{oil\ 1}$ and $T_{oil\ 2}$ are for the tracer concentrations within the oil produced from the first production zone 106*a* and the second production zone 106*b* respectively. Such an abrupt shut-off gives rise to curves with exponential decay. $Q_1$ and $Q_2$ are the oil influx rates into the two completion zones. The quantity a is a geometrical constant of the annular production zones, here simplified to be the same in both zones. While primarily described as being the same in both zones, in some implementations, a can be different in each zone. The quantity a is approximately equal to 1/V, where V is the volume of the annular region in each completion zone, extending from the mouth of the capillary dosing line up to the inlet of the inflow control valve. For this abrupt-shutoff injection profile, comparing the exponential decays of the two zones' oil tracers (or the ratio of their straight-line slopes when plotted on a semi-logarithmic plot as shown in FIG. 4C) will precisely give the ratio of $Q_1$ to $Q_2$, allowing the influx rates to be measured. The surface separator gives us the sum ($Q_1$+$Q_2$) to normalize the absolute oil influx rates. As the decay rate can, in some implementations, follows equations (3) and (4), as little as two measurements need to be taken to determine the decay curves. While these equations are applicable to decay curves with exponential decay, other equations can be used with different decay shapes. In certain situations, such as laminar flow situations, similar equations can be used for both oleophilic tracers and hydrophilic tracers.

Figure 5:
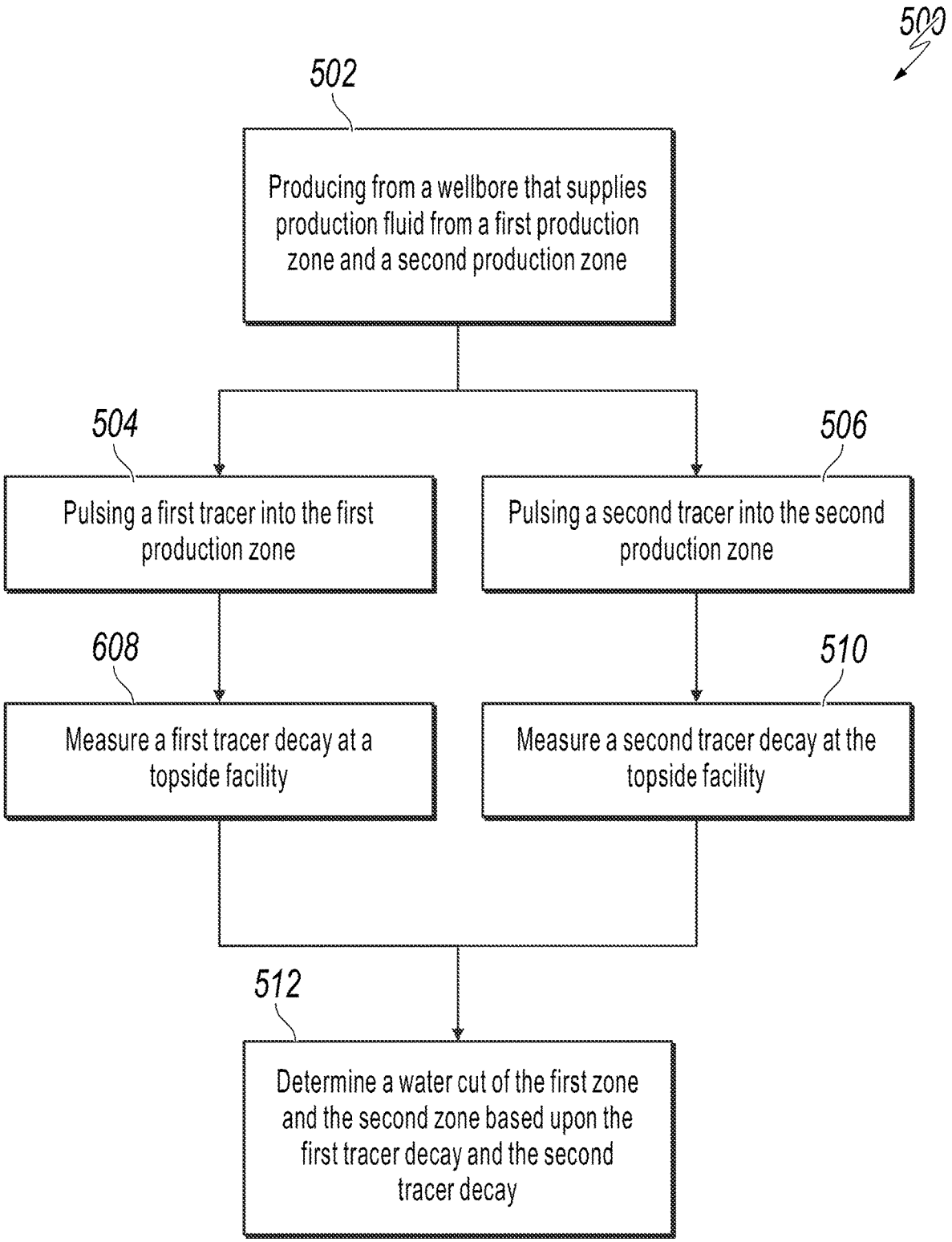
FIG. 5 is an example method that can be used with aspects of this disclosure.

FIG. 5 is an example method 500 that can be used with aspects of this disclosure. In some implementations, all or some of the method steps are performed by the controller 116. At 502, production fluid is produced from the production well 104. The production well 104 supplies production fluid from the first production zone 106*a* and the second production zone 106*b*. Production fluids from the first production zone 106*a* and second production zone 106*b* are comingled within the same production tubing 108.

At 504, a first tracer 206 is pulsed into the first production zone. At 506, a second tracer 212 is pulsed into the second production zone. The first tracer 206 and the second tracer 212 are barcoded such that the first tracer 206 and the second tracer 212 can be differentiated from one another. For example, the first tracer 206 and the second tracer 212 can fluoresce at different wavelengths. In some implementations, additional tracers can be used without departing from this disclosure, for example, a third tracer can be injected into the first production zone 106*a* and a fourth tracer can be injected into the second production zone 106*b*. In such implementations, the tracers in each zone can include hydrophilic and oleophilic tracers, for example, the first and second tracers are oleophilic tracers and while the third and fourth tracers are hydrophilic tracers.

At 508, a decay of the first tracer is measured at the topside facility 102. At 510, a decay of the second tracer is measured at the topside facility 102. In some implementations, the decay of the first tracer and the second tracer can be measured substantially simultaneously. For example, production samples can be taken at the topside facility 102 at specified intervals. Each sample is then tested to determine tracer concentrations of the first tracer 206 and the second tracer 212 at the specified time intervals. From there, a decay slope of each tracer in each zone can be determined based upon the tested samples.

At 512, a water cut of the first zone and the second zone is determined based upon the first tracer decay and the second tracer decay. Such a determination can be make using the equations described throughout this disclosure. Alternatively or in addition, oil production rates of the first production zone and the second production zone are determined based upon the first tracer decay and the second implementation decay. The water cut can be determined using either hydrophilic tracers, oleophilic tracers, or both. Regardless of the tracer used, responsive to the determined water-cuts, in some implementations, the first subsurface control valve 110*a*, the second subsurface control valve 110*b*, or both, are actuated to regulate the flow of production fluids from their respective zones. Throughout the entirety of the processes and methods described herein, including while pulsing the first tracer, while pulsing the second tracer, while measuring the decay of the first tracer, and while measuring the decay of the second tracer, production of each zone remains relatively continuous (within standard operation windows).

While this disclosure contains many specific implementation details, these should not be construed as limitations on the scope of any inventions or of what may be claimed, but rather as descriptions of features specific to particular implementations. Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the implementations described above should not be understood as requiring such separation in all implementations, and it should be understood that the described program components and systems can generally be integrated together in a single product or packaged into multiple products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results.

What is claimed is:

1. A method comprising:

producing from a wellbore that supplies production fluid from a first production zone and a second production zone, production fluids from the first and second production zone being comingled within a same production tubular;

pulsing a first tracer into the first production zone;

pulsing a second tracer into the second production zone, the first tracer and the second tracer being barcoded such that the first tracer and the second tracer can be differentiated from one another;

measuring a first tracer decay at a topside facility;

measuring a second tracer decay at the topside facility; and determine a water cut of the first production zone and the second production zone based upon the first tracer decay and the second tracer decay.

2. The method of claim 1, further comprising:

actuating a first subsurface control valve to regulate the production fluids from the first production zone; or actuating a second subsurface control valve to regulate the production fluids from the second production zone.

3. The method of claim 1, wherein production remains continuous while pulsing the first tracer, while pulsing the second tracer, while measuring the decay of the first tracer, and while measuring the decay of the second tracer.

4. The method of claim 1, wherein pulsing the first tracer comprises ceasing flow of the first tracer.

5. The method of claim 1, wherein pulsing the second tracer comprises a step-function pulse of a specified duration of time.

6. The method of claim 1, wherein pulsing the first tracer and the second tracer comprise pulsing hydrophilic tracers.

7. The method of claim 1, wherein determining the water cut of the first production zone or the second production zone comprise using the following equation:

$$T_{oil(i)} = \sim \exp(-aQ_i t)$$

wherein $T_{oil(i)}$ is the tracer concentration in oil from a specified production zone, a is a geometrical constant of an annular completion region, approximately equal to 1/V, where V is the volume of the annular region from the mouth of the dosing line up to the mouth of the inflow control valve, $Q_i$ is a total oil production flow rate from the specified production zone, and t is time.

8. The method of claim 1, further comprising:

pulsing a third tracer into the first production zone; and pulsing a fourth tracer into the second production zone.

9. The method of claim 1, wherein measuring a first tracer decay and a second tracer decay comprises:

taking production samples at the topside facility at specified intervals;

testing the samples to determine tracer concentrations at the specified time intervals; and determining a decay slope of each tracer in each zone based upon the tested samples.

10. A system comprising:

production tubing arranged to receive production fluid from a first production zone and a second production zone in a production well;

a first subsurface control valve regulating flow from the first production zone into the production tubing;

a second subsurface control valve regulating flow from the second production zone into the production tubing;

a first actuatable injection tube with a first outlet adjacent to a first inlet of the production tubing within the first production zone;

a second actuatable injection tube with a second outlet adjacent to a second inlet of the production tubing within the second production zone; and a real-time sensor at a topside facility; and a controller configured to:

send a control signal to a first topside pressure pump, the control signal configured to cause the pump to pulse a first tracer into the first production zone;

send a control signal to a second topside pressure pump, the control signal configured to cause the pump to pulse a second tracer into the second production zone, the first tracer and the second tracer being barcoded such that the first tracer and the second tracer can be differentiated from one another;

measure a first tracer decay at a topside facility by the real-time sensor;

measure a second tracer decay at the topside facility by the real-time sensor;

determine a water cut of the first production zone and the second production zone based upon the first tracer decay and the second tracer decay;

send a control signal to the first subsurface control valve, the signal configured to actuate a first subsurface control valve to regulate the production fluids from the first production zone; and send a control signal to the second subsurface control valve, the signal configured to actuate a second subsurface control valve to regulate the production fluids from the second production zone.

11. The system of claim 10, further comprising:

a third injection tube with a third outlet adjacent to the first inlet of the production tubing within the first production zone; and a fourth injection tube with a fourth outlet adjacent to the second inlet of the production tubing within the second production zone.

12. A method comprising:

producing from a wellbore that supplies production fluid from a first production zone and a second production zone, production fluids from the first and second production zone being comingled within a same production tubular;

pulsing a first tracer into the first production zone;

pulsing a second tracer into the second production zone, the first tracer and the second tracer being barcoded such that the first tracer and the second tracer can be differentiated from one another;

measuring a first tracer decay at a topside facility;

measuring a second tracer decay at the topside facility;

determining a water cut of the first production zone and the second production zone based upon the first tracer decay and the second tracer decay;

actuating a first subsurface control valve, responsive to determining the water cut of the first production zone and the second production zone, to regulate the production fluids from the first production zone; and actuating a second subsurface control valve, responsive to determining the water cut of the first production zone and the second production zone, to regulate the production fluids from the second production zone.

13. The method of claim 12, wherein pulsing the second tracer comprises ceasing flow of the first tracer.

14. The method of claim 12, wherein pulsing the first tracer comprises a step-function pulse of a specified duration of time.

15. The method of claim 12, wherein determining the water cut of the first production zone and the second production zone comprise using the following equation:

$$T_{water(i)}=T_o \exp(-aQ_i t)/(Q_1+Q_2)$$

wherein $T_{ater(i)}$ is hydrophilic tracer concentration in water from a specified production zone, $T_o$ is a tracer concentration injected down the dosing line from the surface, a is a geometrical constant of an annular production zone, a being approximately equal to 1/V, where V is an annular volume of the production zone from the mouth of the dosing line up to the mouth of the inflow control valve, $Q_i$ is a total production flow rate from the specified production zone, $Q_1$ is a total production flowrate from the first production zone, $Q_2$ is a total production rate from the second production zone, and t is time.

16. The method of claim 12, further comprising:

pulsing a third tracer into the first production zone; and pulsing a fourth tracer into the second production zone.

17. The method of claim 12, wherein measuring a first tracer decay and a second tracer decay comprises:

taking production samples at the topside facility at specified intervals;

testing the samples to determine tracer concentrations at the specified time intervals; and determining a decay slope of each tracer in each zone based upon the tested samples.

18. The method of claim 12, wherein production remains continuous during pulsing and measuring.

19. The method of claim 12, wherein pulsing the first tracer and the second tracer comprise pulsing oleophilic tracers.

* * * * *